US007396628B2

(12) United States Patent
Ninomiya et al.

(10) Patent No.: US 7,396,628 B2
(45) Date of Patent: Jul. 8, 2008

(54) TONER FOR ELECTROSTATIC CHARGE IMAGE DEVELOPING, DEVELOPER FOR ELECTROSTATIC CHARGE IMAGE DEVELOPING, AND IMAGE FORMING APPARATUS

(75) Inventors: Masanobu Ninomiya, Minamiashigara (JP); Hiroshi Nakazawa, Minamiashigara (JP); Takao Ishiyama, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 408 days.

(21) Appl. No.: 11/152,146

(22) Filed: Jun. 15, 2005

(65) Prior Publication Data

US 2006/0210904 A1 Sep. 21, 2006

(30) Foreign Application Priority Data

Mar. 15, 2005 (JP) ..... 2005-073715

(51) Int. Cl.
*G03G 9/093* (2006.01)

(52) U.S. Cl. ..... 430/110.2; 430/111.4

(58) Field of Classification Search ..... 430/110.2, 430/111.4

See application file for complete search history.

(56) References Cited

U.S. PATENT DOCUMENTS

| | | | | |
|---|---|---|---|---|
| 5,281,505 | A | 1/1994 | Inoue et al. | |
| 5,753,399 | A * | 5/1998 | Hayase et al. | 430/109.3 |
| 7,001,701 | B2 * | 2/2006 | Fujii et al. | 430/108.4 |
| 2003/0134215 | A1 | 7/2003 | Kashiwabara et al. | |
| 2004/0191656 | A1 | 9/2004 | Ishiyama et al. | |

FOREIGN PATENT DOCUMENTS

| | | |
|---|---|---|
| EP | 1 283 451 | 2/2003 |
| JP | A 04-24702 | 4/1992 |
| JP | A 08-234480 | 9/1996 |
| JP | A 09-325520 | 12/1997 |
| JP | A 10-123748 | 5/1998 |

* cited by examiner

*Primary Examiner*—John L Goodrow
(74) *Attorney, Agent, or Firm*—Oliff & Berridge, PLC

(57) ABSTRACT

Provided is a toner for electrostatic charge image developing, comprising a core layer which contains a first binder resin and a coloring agent, and a shell layer which contains a second binder resin and covers the core layer, characterized in that the following equation (1) and the following equation (2) are satisfied, $$2.0\times10^5 \leqq G'(60) \leqq 4.0\times10^6 \quad \text{Equation (1)}$$

$$10 \leqq G'(60)/G'(80) \leqq 40 \quad \text{Equation (2)}$$

wherein, in the equation (1) and the equation (2), G'(60) represents a storage elastic modulus (Pa) of the toner for electrostatic charge image developing measured under the conditions of a temperature of 60° C., a vibration frequency of 6.28 rad/sec, and a strain amount of 0.01 to 0.5%, and G'(80) represents a storage elastic modulus (Pa) of the toner for electrostatic charge image developing measured under the conditions of a temperature of 80° C., a vibration frequency of 6.28 rad/sec, and a strain amount of 0.01 to 0.5%.

Also provided is a developer for electrostatic charge image developing comprising the toner and a carrier, and an image forming apparatus using the toner.

10 Claims, No Drawings

TONER FOR ELECTROSTATIC CHARGE IMAGE DEVELOPING, DEVELOPER FOR ELECTROSTATIC CHARGE IMAGE DEVELOPING, AND IMAGE FORMING APPARATUS

CROSS-REFERENCE TO RELATED APPLICATION

This application claims priority under 35 USC 119 from Japanese Patent Application No.2005-073715, the disclosure of which is incorporated by reference herein.

BACKGROUND OF THE INVENTION

1. Field of the Invention

The present invention relates to a toner for electrostatic charge image developing which is suitably used in image formation by electrophotography, as well as a developer for electrostatic charge image developing, and an image forming apparatus, using the toner for electrostatic charge image developing.

2. Description of the Related Art

Conventionally, when an image is formed in a copying machine or a laser beam printer, electrophotography is generally used. As the developer-used in electrophotography, a two-component developer containing a toner and a carrier, and a one-component developer containing a magnetic toner or a non-magnetic toner, are known. The toner used in these developers is usually prepared by a kneading grinding method.

This kneading grinding method is a method of melting and kneading a thermoplastic resin with a pigment, a charge controlling agent, and a releasing agent such as wax, finely-dividing and classifying this melt kneaded material after cooling to obtain desired toner particles. If necessary, inorganic and/or organic fine particles are further added to the surface of toner particles prepared by the kneading grinding method for the purpose of improving flowability and cleanability.

According to an image forming method using electrophotography, an electrostatic latent image formed on a photoreceptor by an optical means is developed in a developing step, transferred onto a recording medium such as a recording paper in a transferring step, and fixed onto a recording medium such as a recording paper generally by heat and pressure, to obtain an image.

In recent years, the development of electrophotography technique from black and white to full color has progressed rapidly. Color image formation using full color electrophotography generally reproduces all colors using four colors; namely, the three primary colors of yellow, magenta and cyan plus black.

In general full color electrophotography, a manuscript is first color-separated into yellow, magenta, cyan and black, and an electrostatic latent image of each color is formed on a photoconductive layer.

Then, a toner is retained on a recording medium via a developing step and a transferring step. Then, the aforementioned steps are successively performed a plurality of times, and a toner is overlaid on the same recording medium while being positioned.

Then, a full color image is obtained by a one time fixing step. For a color toner used in full color electrophotography, it is required that a multicolor toner is sufficiently mixed at the fixing step. Sufficient mixing improves color reproducibility and transparency of an OHP image, and a full color image having high image quality can be obtained. In order to enhance color mixing property, it is generally desired that a color toner is formed from a low-molecular resin which is sharply melted.

Meanwhile, recently, power consumption saving and higher image quality have also come to be demanded in electrophotography. As one strategy for saving power consumption in electrophotography, fixation at a lower temperature is sought for the purpose of decreasing the amount of energy used when operating a machine.

In order to respond to such a need, new approaches have been adopted on both the toner side and the apparatus side.

As an approach on the toner side, various attempts have been made to lower the fixing temperature of a toner. For example, a method of controlling the viscoelasticity of a toner (see Japanese Patent Application Laid-Open (JP-A) No. 9-325520, and JP-A No.8-234480), and a toner using a crystalline resin as a binder resin have been proposed (Japanese Patent Application Publication (JP-B) No. 4-24702). In addition, in recent years, many toners having a core shell structure consisting of a core layer, and a shell layer covering this core layer have been proposed (for example, see JP-A No. 10-123748).

Among them, in particular, a toner having a core shell structure is a most useful technique in that it is easy to realize not only low temperature fixability, but also other properties in a better balance.

Meanwhile, as an approach on the apparatus side, an apparatus having the functions of decreasing the amount of electric power supplied to a fixing machine in a prolonged state when no image is formed (standby time), and maintaining the temperature of a heating means such as a heating roll at a temperature lower than the temperature at fixing (hereinafter, also referred to as "standing time power saving function"), in order to reduce consumed energy during standby, has been adopted.

In an apparatus having such functions, since it is necessary to secure not only power consumption saving but also convenience, it is preferable to adopt as a fixing machine one having a smaller heat capacity. This is because when an apparatus is used in a state where the amount of power supplied to a heating means of a fixing machine has decreased, and the temperature of the heating means is lower than the temperature necessary for fixing, the temperature of the heating means is instantly elevated to the temperature necessary for fixing at the same time as the electric power is turned on, from the viewpoint of convenience.

In an image forming apparatus having such a standing time power saving function, in the standby state, the temperature of the heating means of the fixing machine is maintained at a temperature lower than the temperature during fixing, in order to suppress the amount of power consumption. For this reason, when one tries to form an image from the standby state, electric power is supplied at once in order to instantly raise the heating means to a temperature at which fixing is possible, and a phenomenon whereby an apparatus is heated to a temperature higher than a prescribed set temperature (over shoot) occurs temporarily. Thereupon, when paper is supplied to the fixing machine for image formation, since heat is absorbed by the paper passed through the fixing machine, the temperature of the fixing machine is lowered from the over shoot state.

In addition, in addition to the aforementioned over shoot immediately after initiation of image formation (hereinafter, also referred to as "initial over shoot"), periodic over shoot also occurs even when an image is continuously formed, since lowering of temperature due to supplied paper and, when the temperature is lower than the prescribed temperature, elevation of temperature due to heating are repeated (hereinafter, referred to as "steady over shoot").

When an image is formed, occurrence of such over shoot cannot be avoided. For this reason, there is a deviation in an actual fixing temperature in each sheet, resulting in both paper which is fixed at a temperature higher than the set temperature and paper which is fixed at a temperature lower than the set temperature. Such remarkable deviation in temperature results in unevenness of image quality. Therefore, a fixing machine built into an image forming apparatus is designed so that temperature deviation during image formation is within a prescribed range, so as not to cause unevenness of image quality.

However, when images are continuously formed from the standby state with an image forming apparatus having a standby time power saving function using a toner having a core shell structure excellent in low temperature fixability, in some cases the tone of a formed image varies from sheet to sheet, and this is particularly pronounced in multiple color images using 2 or 3.

SUMMARY OF THE INVENTION

A first aspect of the present invention provides a toner for electrostatic charge image developing having a core layer which contains a first binder resin and a coloring agent, and a shell layer which contains a second binder resin and covers the core layer, characterized in that the following equation (1) and the following equation (2) are satisfied:

$$2.0\times10^5 \leqq G'(60) \leqq 4.0\times10^6 \quad \text{Equation (1):}$$

$$10 \leqq G'(60)/G'(80) \leqq 40 \quad \text{Equation (2):}$$

wherein in the equation (1) and the equation (2), G'(60) represents a storage elastic modulus (Pa) of the toner for electrostatic charge image developing measured under the condition of a temperature of 60° C., a vibration frequency of 6.28 rad/sec, and a strain amount of 0.01 to 0.5%, and G'(80) represents a storage elastic modulus (Pa) of the toner for electrostatic charge image developing measured under the condition of a temperature of 80° C., a vibration frequency 6.28 rad/sec, and a strain amount of 0.01 to 0.5%.

A second aspect of the invention provides a developer for electrostatic charge image developing, comprising the toner for electrostatic charge image developing of a first aspect, and a carrier.

A third aspect of the invention provides an image forming apparatus, comprising an image carrying body, an charging means for charging a surface of the image carrying body, an exposing means for forming an electrostatic latent image on a surface of the charged image carrying body depending on image formation, a developing means for developing the electrostatic latent image with a developer containing a toner to form a toner image on a surface of the image carrying body, a transferring means for transferring the toner image onto a surface of a recording medium from a surface of an image carrying body, and a fixing means for heating and pressing the toner image transferred onto a surface of the recording medium to fix this to form an image, wherein the toner is the toner for electrostatic charge image developing of a first aspect.

DETAILED DESCRIPTION OF THE INVENTION

In order to attain the aforementioned objects, the present inventors intensively studied a cause for change in a tone when an image is continuously formed by an image forming apparatus having waiting term power saving function, first, from a viewpoint of an image forming apparatus, using a toner having a core shell structure.

As described above, upon image formation, deviation of a fixing temperature due to over shoot occurs. In particular, it cannot be avoided that a rise in a temperature due to initial over shoot caused by heating at once from a low temperature maintained in the waiting state is greater than a rise in the temperature due to steady over shoot. Therefore, it is thought that a maximum deviation width of a fixation temperature when an image is continuously formed corresponds to a difference between a temperature at a time point where a temperature due to initial over shoot is risen up, and a temperature at a valley between periodically repeated steady over shoot and steady over shoot.

In addition, in a fixing machine built in an image forming apparatus having waiting term power saving function, heat capacity thereof is preferably smaller for enhancing energy saving effect and, further, in a compact size image forming apparatus, heat capacity of a fixing machine is necessarily reduced. In such the case, the aforementioned maximum deviation width of a fixing temperature easily becomes higher than usual, but suppression of such the temperature scatter has a limit. In addition, in recent years, since a toner capable of low temperature fixation is being utilized, a fixing temperature itself is being lowered in response to this.

On the other hand, since the conventional toner having a core shell structure excellent in low temperature fixability has sharp melt property, when it is used at a temperature even slightly shifted from a fixing temperature which is scheduled in actual use, the melt state of a toner is rapidly changed easily. For this reason, when a maximum deviation width of a fixing temperature becomes greater, the conventional toner having a core shell structure has a tendency that color developing property influenced by the melt state of a toner is easily scattered.

Like this, the conventional toner having a core shell structure has a potential problem that, accompanied with energy saving of an apparatus, unevenness of color developing property easily occurs. However, at present, this is not actualized to an extent of a practical problem. For this reason, such the problem has not previously been studied deeply.

However, the present inventors further studied intensively, and confirmed that unevenness of color developing property is inclined to be more accelerated as a fixing temperature is lower or in image formation with a binary color or a ternary color in which absorption of heat by a transferred toner image tends to be greater. Therefore, unless such the problem is solved, it is extremely difficult to respond to energy saving which will be further sought from now on, while an excellent image quality is maintained. The present inventors found out the following invention based on the above-explained finding.

That is, the invention is:

<1> A toner for electrostatic charge image developing having a core layer which contains a first binder resin and a coloring agent, and a shell layer which contains a second binder resin and covers the core, characterized in that the following equation (1) and the following equation (2) are satisfied, $$2.0\times10^5 \leqq G'(60) \leqq 4.0\times10^6 \quad \text{Equation (1):}$$

$$10 \leqq G'(60)/G'(80) \leqq 40 \quad \text{Equation (2):}$$

wherein in the equation (1) and the equation (2), G'(60) represents a storage elastic modulus (Pa) of the toner for electrostatic charge image developing measured under the condition of a temperature of 60° C., a vibration frequency of 6.28 rad/sec, and a strain amount of 0.01 to 0.5%, and G'(80) represents a storage elastic modulus (Pa) of the toner for electrostatic charge image developing measured under the condition of a temperature of 80° C., a vibration frequency 6.28 rad/sec, and a strain amount of 0.01 to 0.5%;

<2> The toner for electrostatic charge image developing according to <1>, wherein two maximum peaks of a tangential loss measured under the condition of a vibration frequency of 6.28rad/sec, and a strain amount of 0.01 to 0.5% are present in a range of not lower than 30° C. and not higher than 90° C.;

<3> The toner for electrostatic charge image developing according to <1> or <2>, wherein a difference ΔSP (|SPc−SPs|) between a solubility parameter SPc of first binder resin and a solubility parameter SPs of the second binding resin is in a range of 0.2 to 0.6;

<4> A developer for electrostatic charge developing, comprising the toner for electrostatic charge image developing as defined in any one <1> to <3>;

<5> An image forming apparatus, comprising an image carrying body, an charging means for charging a surface of the image carrying body, an exposing means for forming an electrostatic latent image on a surface of the charged image carrying body depending on image formation, a developing means for developing the electrostatic latent image with a developer containing a toner, a developing means for forming a toner image on a surface of the image carrying body, a transferring means for transferring the toner image onto a surface of a recording medium from a surface of the image carrying body, and a fixing means for heating and pressing the toner image transferred onto a surface of the recording medium to fix this, to form an image, wherein the toner is the toner for electrostatic charge image developing as defined in any one of <1> to <3>;

<6> The image forming apparatus according to <5>, wherein the fixing means contains a heating means having at least function of heating the toner image, and has function of maintaining a temperature of the heating means at a temperature lower than a temperature at the fixation when the state where no image is formed continues;

<7> The image forming apparatus according to <5> or <6>, wherein an actual average fixing temperature of the fixing means is 120° C. or lower.

According to the invention, a toner for electrostatic charge image developing in which low temperature fixation is possible, at the same time, even when an image is continuously formed, there is little change in a tone between images formed in each sheet, and a developer for electrostatic charge image developing, and an image forming apparatus using the toner for electrostatic charge image developing can be provided.

<Toner for Electrostatic Charge Image Developing>

The toner for electrostatic charge image developing of the invention (hereinafter, referred to as "toner" in some cases) is a toner for electrostatic charge image developing having a core layer which contains a first binder resin and a coloring agent, and a shell layer which contains a second binder resin and covers the core layer, characterized in that the following equation (1) and the following equation (2) are satisfied:

$$2.0\times10^5 \leqq G'(60) \leqq 4.0\times10^6 \quad \text{Equation (1)}$$

$$10 \leqq G'(60)/G'(80) \leqq 40 \quad \text{Equation (2)}$$

wherein in the equation (1) and the equation (2), G'(60) represents a storage elastic modulus (Pa) of the toner for electrostatic charge image developing measured under the condition of a temperature of 60° C., a vibration frequency of 6.28 rad/sec, and a strain amount of 0.01 to 0.5%, and G'(80) represents a storage elastic modulus (Pa) of the toner for electrostatic charge image developing measured under the condition of a temperature of 80° C., a vibration frequency 6.28 rad/sec, and a strain amount of 0.01 to 0.5%.

The toner of the invention enables lower temperature fixation since a storage elastic modulus G' (60) at 60° C. is in a range of not less than $2.0\times10^5$ Pa and not more than $4.0\times10^6$ Pa as shown in the equation (1). When a storage elastic modulus G' (60) at 60° C. is less than $2.0\times10^5$ Pa, since elasticity of a toner is small, a toner is easily deformed at a step of transferring a toner, leading to deteriorated transference. On the other hand, when a storage elastic modulus G'(60) at 60° C. is more than $4.0\times10^6$ Pa, since elasticity of a toner is large, fixation at a low temperature becomes difficult.

A storage elastic modulus G' (60) at 60° C. is preferably in a range of not less than $5\times10^5$ Pa and not more than $3\times10^6$ Pa, more preferably in a range of not less than $8\times10^5$ Pa and not more than $2\times10^6$ Pa.

In addition, in the toner of the invention, since a ratio G'(60)/G'(80) of a storage elastic modulus G'(60) at 60° C. and a storage elastic modulus G'(80) at 80° C. is in a range of not less than 10.0 and not more than 40.0 as shown in the equation (2), even when an image is continuously formed, there is little change in a tone (color developing property) between images formed in each sheet and, also when the toner is fixed at a lower temperature, the same effect can be maintained. Additionally, color developing property of a formed image can be retained high.

Herein, a ratio G'(60)/G'(80) of a storage elastic modulus G'(60) at 60° C. and a storage elastic modulus G'(80) at 80° C. is an index showing temperature dependency of viscoelasticity of a toner at a low temperature and, when G'(60)/G'(80) is great, sharp melt property of a toner is strong and, when the ratio is small, sharp melt property is weak.

When G'(60)/G'(80) is more than 40, since temperature dependency of viscoelasticity of a toner is too great, unevenness of color developing property in each sheet when an image is continuously formed becomes remarkable, and a stable image is not obtained. In addition, when G'(60)/G'(80) is less than 10, since viscoelasticity of a toner at 80° C. is great, a toner is not sufficiently melted at a low temperature, and color developing property itself is reduced.

G'(60)/G'(80) is preferably not less than 10 and not more than 30, more preferably not less than 15 and not more than 25.

In the toner of the invention, it is preferable that a tangential loss measured at a vibration frequency of 6.28 rad/sec and a strain amount of 0.01 to 0.5% has two peaks (maximum) in a range of not lower than 30° C. and not higher than 90° C. This peak of a tangential loss indicates movement of a main chain of a binder resin component contained in a toner, and when two peaks are present, it is shown that two kinds of binder resins are present independently in a toner in the non-compatible state.

In the toner of the invention, since a first binder resin contained in a core layer, and a second binder resin contained in a shell layer are used, the presence of two peaks of a tangential loss means that these two kinds of binder resins are present independently in a toner in the non-compatible state.

Like this, the state where two peaks of a tangential loss are present in a range of not lower than 30° C. and not higher than 90° C. is preferable in that it becomes easy to control temperature dependency (slope) of viscoelasticity of a toner so that the condition shown in the equation (2) is satisfied.

In the state where only one peak of a tangential loss is present in a range of not lower than 30° C. and not higher than 90° C., since two kinds of binder resins are compatible in a toner, a slope of temperature dependency of toner viscoelasticity may be slightly changed, and only a temperature dependency curve of viscoelasticity may be easily shifted. For this reason, it becomes difficult to control temperature dependency (slope) of viscoelasticity of a toner so that the condition shown in equation (2) is satisfied, in some cases.

In the invention, a storage elastic modulus and a tangential loss (loss elastic modulus) were obtained from dynamic viscoelasticity measured by a sine wave vibration method. For measuring dynamic viscoelasticity, an ARES measuring apparatus manufactured by Rheometric Scientific was used.

For measuring dynamic viscoelasticity, a toner was molded into a tablet, and set on a parallel plate having a diameter of 8mm, a normal force was made to 0, and sine wave vibration was imported at a vibration frequency of 6.28 rad/sec. Measurement was initiated at 20° C., and continued to 100° C. at a temperature raising rate of 1° C./min. Thereupon, a measurement time interval is 30 seconds.

Before measurement, stress dependency of a strain amount was confirmed at 20° C. to 100° C. at an interval 100° C., and a range of a strain amount in which a stress and a strain amount at each temperature satisfying linear relationship was obtained. During measurement, a strain amount at each measurement temperature was controlled so that a strain amount is maintained in a range of 0.01% to 0.5%, and a stress and a strain amount form a linear relationship at all temperatures, and a storage elastic modulus and a tangential loss were obtained utilizing these measurement results.

Then, a process for preparing a toner of the invention, and a constitutional material will be explained. A process for preparing a toner of the invention is not particularly limited as far as it is a process which can prepare a toner having a so-called core shell structure having a core layer which contains a first binder resin and a coloring agent, and a shell layer containing a second binder resin and covering a core layer, but the known process can be utilized and, in general, it is preferable to utilize a wet process, particularly, an emulsion polymerization aggregating method.

In this case, it is preferable that a process for manufacturing a toner comprises an aggregating step of forming core particles by adding an aggregating agent to a mixed dispersion obtained by mixing at least a first resin fine particle dispersion in which first resin fine particles comprising a first binder resin and having a volume average particle diameter of 1 μm or less are dispersed, and a coloring agent dispersion in which a coloring agent is dispersed, and heating this, an adhering step of adding a second resin fine particle dispersion in which second resin fine particles comprising a second binder resin and having a volume average particle diameter of 1 μm or less are dispersed to a mixed dispersion in which core particles are formed, to adhere second resin fine particles to a surface of core particles to form adhered resin aggregated particles, and a fusing step of fusing adhered resin aggregated particles.

In the aggregating step, core particles obtained only by aggregating various fine particle components in a mixed solution (core aggregated particles) may be formed, or core particles obtained by raising a heating temperature higher than a glass transition temperature of a binder resin to aggregate and fuse particles at the same time (core fused particles) may be formed. In addition, a fusing step may be performed by heating to a temperature which is higher of glass transition temperatures of first or second binder resins whichever is higher and, when adhered resin aggregating particles are formed using core fused particles, fusion may be performed utilizing a mechanical stress. Details of these steps will be described later.

The toner of the invention is such that a core layer contains a first binder resin and a coloring agent, and a shell layer contains a second binder resin. Besides, if necessary, a releasing agent and various additives may be internally added, or various external additives such as a flowing aid may be externally added.

Constitutional materials of the toner of the invention will be explained below in more detail, taking the case of utilization in the aforementioned emulsion polymerization aggregating method into consideration. Of course, materials listed below may be utilized in the case where the toner of the invention is prepared by other process.

-First Binder Resin (Binder Resin for Core Layer)-

As a first binder resin used in the invention (hereinafter, referred to as "binder resin for core layer" in some cases, the known non-crystalline or crystalline resins may be utilized and, in the case of the non-crystalline resin, specifically, the following materials may be utilized.

That is, examples of the non-crystalline resin include monomers and polymers such as styrenes such as styrene, parachlorostyrene, and α-methylstyrene; esters havins a vinyl group such as methyl acrylate, ethyl acrylate, n-propyl acrylate, lauryl acrylate, 2-ethylhexyl acrylate, methyl methacrylate, ethyl methacrylate, n-propyl methacrylate lauryl methacrylate and 2-ethylhexyl methacrylate; vinylnitriles such as acrylonitrile, and methacrylonitrile; vinyl ethers such as vinyl methyl ether and vinyl isobutyl ether; vinyl ketones such as vinyl methyl ketone, vinyl ethyl ketone and vinyl isopropenyl ketone; polyolefins such as ethylene, propylene and butadiene; copolymers as a combination of two or more kinds of these monomers, and a mixture of these polymers and copolymers.

In addition to the aforementioned resins, further examples include an epoxy resin, a polyester resin, a polyurethane resin, a polyamide resin, a cellulose resin, a polyether resin, and a non-vinyl condensed resin, and a mixture of these with a vinyl-based resin synthesized using the aforementioned vinyl-monomer, as well as a graft polymer obtained by polymerizing a vinyl-based monomer in the presence of them. These resins may be used alone, or two or more kinds of them may be used jointly.

Among them, when a vinyl-based monomer is used, a resin fine particle dispersion can be prepared by performing emulsion polymerization or seed polymerization using an ionic surfactant and, when other resin is used, a desired resin fine particle dispersion can be prepared by dissolving a resin in a solvent which is oily and has relatively low solubility in water, dispersing a fine particle in water with a dispersing machine such as a homogenizer in the presence of an ionic surfactant or a polymer electrolyte in water, and evaporating a solvent by heating or evacuating.

The thermoplastic binder resin can be stably prepared as fine particles obtained by emulsion polymerization, by blending a dissociable vinyl-based monomer.

As a dissociable vinyl-based monomer, any monomer which is a raw material of a polymer acid or a polymer base such as acrylic acid, methacrylic acid, maleic acid, cinnamic acid, fumaric acid, vinylsulfonic acid, ethyleneimine, vinylpyridine, and vinylamine can be used. From easiness of a reaction for forming a polymer, a polymer acid is suitable. Further, a dissociable vinyl-based monomer having a carboxyl group such as acrylic acid, methacrylic acid, maleic acid, cinnamic acid, and fumaric acid is particularly effective for controlling a polymerization degree, or controlling a glass transition point.

Alternatively, as a binder resin for a core layer, a crystalline resin may be used. Herein, "crystalline" indicates not stepwise change in an endothermic amount, but having a clear endothermic peak in differential scanning calorimetry (DSC) and, specifically means that a half width of an endothermic peak when measured at a temperature raising rate of 10° C./min is within 6° C.

Among the crystalline resin, a polyester resin is preferable from a practical view point of retainability of an image after formation of a toner. An example of a polyester resin will be explained below, but the invention is not limited to it.

The crystalline polyester resin and all other polyester resins used in the invention are synthesized from a polyvalent carboxyl acid component and a polyhydric alcohol component. In the invention, as the polyester resin, a commercially available product may be used, or the resin obtained by synthesis may be appropriately used.

Examples of the polyvalent carboxyl acids include aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, and 1,18-octadecanedicarboxylic acid, aromatic dicarboxylic acids such as phthalic acid, isophthalic acid, terephthalic acid, and naphthalene-2,6-dicarboxylic acid, and malonic acid, mesaconic acid, and an anhydride or a lower alkyl ester thereof.

Examples of tri-or more-valent carboxylic acid include 1,2,4-benzenetricarboxylic acid, 1,2,5-benzenetricarboxylic acid, 1,2,4-naphthalenetricarboxylic acid, and an anhydride or a lower alkyl ester thereof. These may be used alone, or two or more kinds may be used jointly.

It is preferable that, as an acid component, in addition to the aforementioned aliphatic dicarboxylic acids and aromatic dicarboxylic acids, dicarboxylic acid component having a sulfonic acid group is contained. The dicarboxylic acid having a sulfonic acid group is effective in that a coloring material such as a pigment can be dispersed better. In the case where dicarboxylic acid has a sulfonic acid group, when resin fine particles are prepared by emulsifying or suspending an entire resin in water, it is also possible to emulsify or suspend the resin without using a surfactant as described later.

Examples of dicarboxylic acid having a sulfonic acid group include a sodium 2-sulfoterephthalate salt, a sodium 5-sulfoisophthalate salt, and a sodium sulfosuccinate salt, being not limiting. Further examples include a lower alkyl ester; and an anhydride thereof These di- or more-valent carboxylic acid components having a sulfonic acid group are contained preferably at 1 to 15 mole %, more preferably at 2 to 10 mole % relative to a total carboxylic acid component constituting polyester.

When a content is small, stability of emulsified particles with time may be deteriorated. On the other hand, when a content exceeds 15 mole %, not only crystallizability of a polyester resin may be reduced, but also inconvenience easily arises that, after aggregation, a step of fusing particles may be adversely influenced, and adjustment of a toner diameter may become difficult.

Further, it is preferable that, in addition to the aforementioned aliphatic dicarboxylic acids and aromatic dicarboxylic acids, a dicarboxylic acid component having a double bond is contained. Dicarboxylic acid having a double bond can be preferably used for preventing hot offset at fixation that it can be radically cross-linking-bound via a double bond. Examples of such the dicarboxylic acid is not limited to, but include maleic acid, fumaric acid, 3-hexenedioic acid, and 3-octenedioic acid. Further examples include a lower ester, and an acid anhydride thereof Among them, examples include fumaric acid, and maleic acid from a viewpoint of a cost.

As a polyhydric alcohol component, aliphatic diol is preferable, and a straight aliphatic diol having a carbon number of a main chain part of 7 to 20 is more preferable. Since when the aliphatic diol is a branched-type, crystallizability of a polyester resin may be reduced, and a melting point may be lowered, toner blocking resistance, image retainability, and low temperature fixability are deteriorated in some cases. When a carbon number is less than 7, in the case where the alcohol component is polycondensed with aromatic dicarboxylic acid, a melting point may be elevated, and low temperature fixation becomes difficult in some cases. On the other hand, when a carbon number exceeds 20, it easily becomes difficult to obtain practical materials. It is preferable that the carbon number is 14 or less.

Examples of aliphatic diol which is preferably used in synthesis of crystalline polyester used in the invention are not limited to, but include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, and 1,18-octadecanediol. Among them, when easy availability is taken into consideration, 1,8-octanediol, 1,9-nonanediol, and 1,10-decanediol are preferable.

Examples of a tri- or more-hydric alcohol include glycerin, trimethylolethane, trimethylolpropane, and pentaerythritol. These may be used alone, or two or more kinds may be used jointly.

Of a polyhydric alcohol component, a content of the aliphatic diol component is preferably 80 mole % or more, more preferably 90 mole % or more. When the content of aliphatic diol component is less than 80 mole %, since crystallizability of a polyester resin may be reduced, and a melting point may be lowered, toner blocking resistance, image retainability, low temperature fixability are deteriorated in some cases. If necessary, for the purpose of adjusting an acid value or a hydroxyl group value, a monovalent acid such as acetic acid, and benzoic acid, and a monohydric alcohol such as cyclohexanol, and benzyl alcohol may be used.

These crystalline resins are dispersed in an aqueous medium such as water together with a polymer electrolyte such as an ionic surfactant, a polymer acid, and a polymer base, the dispersion is heated to a melting point or higher, and treated using a homogenizer or pressure discharge-type dispersing machine which can apply a strong shearing force, thereby, a resin fine particle dispersion can be obtained.

Alternatively, as a binder resin for a core layer used in the invention, a plurality of kinds of resins may be used by mixing them. Further, a crystalline resin and a non-crystalline resin may be mixed.

A volume average particle diameter of resin fine particles used when a toner is manufactured is desirably 1 μm or less, more desirably in a range of 0.01 to 1 μm. When a volume average particle diameter of resin fine particles exceeds 1 μm, a particle size distribution or a shape distribution of the finally obtained toner for electrostatic latent image developing may be widened, free particles may be produced to cause compositional segregation, leading to reduction in performance or reliance.

On the other hand, when a volume average particle diameter of resin fine particles is within the aforementioned range, this is advantageous in that there is not the aforementioned defect, segregation between toners is decreased, dispersing in a toner becomes better, and scatter of performance and reliance is reduced. A volume average particle diameter of resin fine particles can be measured using a micro-track.

-Second Binder Resin (Binder Resin for Shell Layer)-

As a second binder resin used in the invention (hereinafter, referred to as "binder resin for shell layer" in some cases), the same material as that of a binder resin for a core layer can be used. However, it is not so preferable to use a crystalline resin. This is because when a crystalline resin is used as a material constituting a shell layer, which is an outermost layer of a toner, since a crystalline resin has great environment dependency of an electric resistance, charging property of a toner is remarkably reduced under high humidity environment, in some cases.

As a binder resin for a shell layer, it is preferable to select a material, which is easily present in the state where it is not compatible with a binder resin for a core layer in a toner upon manufacturing a toner. Upon manufacturing a toner, it is preferable to select such the manufacturing condition that the non-compatible state is easily realized.

It is more preferable to select a binder resin for a core layer and a binder resin for a shell layer used in manufacturing a toner so that a difference ($\Delta SP=|SPc-SPs|$) between a solubility parameter (SPc) of a binder resin for a core layer and a solubility parameter (SPs) of a binder resin for a shell layer is in a range of 0.2 to 0.6, more preferably in a range of 0.2 to 0.4.

When a ASP value is less than 0.2, a binder resin for a core layer and a binder resin for shell layer may be compatible in a toner, and it becomes difficult to control viscoelasticity that satisfies the condition show by the equation (2), in some cases. When a $\Delta SP$ value is greater than 0.6, affinity between a binder resin for a core layer and a binder resin for a shell layer may become worse, it becomes difficult to uniformly fuse these two kinds of resins, and a toner cannot be formed in some cases.

Further, it is preferable to use a binder resin for a core layer and a binder resin for a shell layer by combining them so that a ratio ($G'_{shell}$ (80)/$G'_{core}$ (80)) of a storage elastic modulus $G'_{core}$ (80) of a binder resin for a core layer at 80° C. and a storage elastic modulus $G'_{shell}$ (80) of a binder resin for a shell layer at 80° C. is 5 to 50. This ratio is more preferably 10 to 30.

When $G'_{shell}$ (80)/$G'_{core}$ (80) is less than 5, it becomes difficult to obtain temperature dependency (slope) of toner viscoelasticity that satisfies the condition shown in the equation (2) in some cases.

When $G'_{shell}$ (80)/$G'_{core}$ (80) is greater than 50, since a difference in storage elastic modulus between a binder resin for a core layer and a binder resin for a shell layer is too great, at fixation, at a single fixation temperature set in a fixing machine, a binder resin for a core layer is melted, and a binder resin for a shell layer is un-melted in some cases. In this case, subsequently, since a melted region and an un-melted region are present on a fixed image, uniformity of an image surface is lost, and color developing property is deteriorated in some cases.

In addition, for easily realizing control of viscoelasticity of a toner which satisfies the condition shown in the equation (2), it is preferable that a storage elastic modulus $G'_{core}$ (80) at 80° C. of a binder resin for a core layer is in a range of $1\times10^4$ Pa to $1\times10^5$ Pa, and a storage elastic modulus $G'_{shell}$ (80) at 80° C. of a binder resin for a shell layer is preferably in a range of $5\times10^4$ Pa to $5\times10^6$ Pa.

In the invention, a SP value (solubility parameter) means a value obtained by the Fedors method. The SP value in this case is defined by the following equation (3).

$$SP=\sqrt{\frac{\Delta E}{V}}=\sqrt{\frac{\sum_i \Delta ei}{\sum_i \Delta vi}} \qquad \text{Equation (3)}$$

In the equation (3), SP represents a solubility parameter, $\Delta E$ represents a cohesive energy (cal/mol), V represents mole volume ($cm^3$/mol), $\Delta ei$ represents a vaporization energy of an $i^{th}$ atom or atomic moiety (cal/atom or atomic moiety), $\Delta vi$ represents a mole volume of an $i^{th}$ atom or atomic moiety ($cm^3$/atom or atomic moiety), and i represents an integer of 1 or more.

The SP value represented by the equation (3) is obtained so that its unit becomes $cal^{1/2}/cm^{3/2}$ as a custom, and is expressed dimensionlessly. In addition, in the invention, since a relative difference in the SP value between two compounds has meaningfulness, a value obtained according to the aforementioned custom is used, and this is expressed dimensionlessly in the invention.

For a reference, when the SP value shown by the equation (3) is converted into a SI unit ($J^{1/2}/m^{3/2}$), 2046 may be multiplied.

-Coloring Agent Particles-

A coloring agent used in a toner is not particularly limited, but the known pigments and dyes can be used. Examples of the pigment include a black pigment, a yellow pigment, an orange pigment, a red pigment, a blue pigment, a purple pigment, a green pigment, a white pigment, and an extender pigment.

Examples of the black pigment include carbon black, copper oxide, manganese dioxide, aniline black and active carbon.

Examples of the yellow pigment include chrome yellow, zinc white, yellow iron oxide, cadmium yellow, chrome yellow, hanza yellow, hanza yellow 10G, benzidine yellow G, benzidine yellow GR, threne yellow, quinoline yellow, and permanent yellow NCG.

Examples of the orange pigment include red chrome yellow, molybdenum orange, permanent orange GTR, pyrazolone orange, Vulcan orange, benzidine orange G, indanthrene brilliant orange RK, and indanthrene brilliant orange GK.

Examples of the red pigment include red iron oxide, cadmium red, red lead, mercury sulfide, Watchung red, permanent red 4R, lithol red, brilliant carmine 3B, brilliant carmine 6B, DuPont oil red, pyrazolone red, rhodamine B lake, lake red C, rose Bengal, eosin red, and alizarin lake.

Examples of the blue pigment include ultramarine blue, cobalt blue, alkali blue lake, Victoria blue lake, fast sky blue, indanthrene blue BC, aniline blue, ultramarine blue, chalco oil blue, methylene blue chloride, phthalocyanine blue, phthalocyanine green and Malachite green oxalate.

Examples of the purple pigment include manganese purple, fast violet B, and methyl violet lake.

Examples of the green pigment include chromium oxide, chrome green, pigment green, phthalocyanine green, malachite green lake, and final yellow green G.

Examples of the white pigment include zinc white, titanium oxide, antimony white, and zinc sulfide.

Examples of the extender pigment include barite powder, barium carbonate, clay, silica, white carbon, talc, and alumina white.

Examples of the dye include various dyes such as basic, acidic, dispersion, and direct dyes, and various dyes such as acridine series, xanthene series, an azo series, a benzoquinone series, an azine series, an anthraquinone series, a dioxazine series, a thiazine series, an azomethine series, an indigo series, a thioindigo series, a phthalocyanine series, an aniline black series, a polymethine series, a triphenylmethane series, a diphenylmethane series, a thiazine series, a thiazole series, and a xanthene series. More specific examples include nigrosine, methylene blue, rose Bengal, quinoline yellow and ultramarine blue.

These coloring agents may be used alone, or two or more kinds may be used together, or they may be used in the state of a solid solution. When two or more kinds are used together, a color of a toner may be regulated arbitrarily by changing a kind of a coloring agent, or a mixing ratio.

A coloring agent is selected from a viewpoint of a hue angle, chroma, brightness, weather resistance, OHP transparency, and dispersibility in a toner. An addition amount of a coloring agent contained in a toner is preferably 1 to 20% by mass, more preferably 4 to 15% by mass.

Upon preparation of a coloring agent dispersion, these coloring agents are dispersed in an aqueous medium by the known method. Upon dispersing, a media-type dispersing machine such as a rotation shear-type homogenizer, a ball mill, a sand mill, and an attritor, and a high pressure opposite corrosion-type dispersing machine are preferably used.

-Releasing Agent Particles-

As a releasing agent used in the invention, the known releasing agent can be utilized. For example, low-molecular polyolefins such as polyethylene, polypropylene, and polybutene; silicones having a softening point by heating; fatty acid amides such as oleic acid amide, erucic acid amide, ricinolic acid amide, and stearic acid amide; vegetable waxes such as ester wax, carnauba wax, rice wax, candelilla wax, Japan wax and jojoba oil; animal waxes such as beewax; mineral and petroleum waxes such as montan wax, ozokerite, ceresin, paraffin wax, microcrystalline wax, and Fisher-Tropsch wax, and modified entities thereof can be used.

A releasing agent dispersion can be obtained by dispersing the releasing agent with a polymer electrolyte such as an ionic surfactant, a polymer acid and a polymer base in water, heating the dispersion to a melting point or higher and, at the same time, finely-dividing this with a homogenizer or a pressure discharge-type dispersing machine which can impart strong shear. In this case, a particle diameter of releasing agent particles dispersed in a releasing agent dispersion can be easily made to be 1 μm or smaller which is suitable for manufacturing a toner.

A volume average particle diameter of releasing agent particles is desirably 1 μm or less, more desirably in a range of 0.01 to 1 μm. When a volume average particle diameter exceeds 1 μm, a particle diameter distribution and a shape distribution of the final resulting toner may be widened, free particles may be produced, and this causes compositional segregation of a toner, leading to reduction in performance or reliance in some cases.

On the other hand, when a volume average particle diameter of releasing agent particles is within the aforementioned range, this is advantageous that there is not the aforementioned defect, segregation between toners is decreased, dispersing in a toner becomes better, and scatter in performance or reliance becomes small. The volume average particle diameter can be measured using, for example, a micro-track.

-Other Components-

Examples of other components, which are internally or externally added to a toner include an charge controlling agent, an inorganic particle, an organic particle, a lubricant, an abrasive, and a magnetic powder.

Examples of the charge controlling agent include dyes such as a quaternary ammonium salt compound, a nigrosine-based compound, and a complex comprising of aluminum, iron or chromium, and a tripheylmethane-based pigment. As the charge controlling agent in the invention, materials which are hardly soluble in water are preferable in respect of control of an ionic strength which influences on stability at aggregation or fusion, and decrease in pollution.

Examples of the inorganic powder include all particles, which are used as a conventional external additive for a toner surface such as silica, alumina, titania, calcium carbonate, magnesium carbonate, tricalcium phosphate, and cerium oxide.

Examples of the organic particles include all particles, which are used as a conventional external additive for a toner surface such as a vinyl-based resin, a polyester resin, and a silicone resin. These inorganic particles or organic particles can be used as a flowing aid, or a cleaning aid.

Examples of a lubricant include fatty acid amide such as ethylene bis-stearic acid amide, and oleic acid amide, and a fatty acid metal salt such as zinc stearate, and calcium stearate. Examples of the abrasive include the aforementioned silica, alumina and cerium oxide.

Examples of the magnetic powder include substances, which are magnetized in a magnetic field. Specific examples include metals ferromagnetic powders such as metals such as iron, cobalt, nickel and manganese, alloys thereof, and compounds containing them, and compounds such as ferrite, and magnetite. When the magnetic powder is used, it is necessary to pay an attention to aqueous layer transferring property of the magnetic entity, and it is preferable to subject the magnetic entity to surface modification such as hydrophobicizing treatment.

When these other components are used in a form of particles in manufacturing a toner, a volume average particle diameter thereof is preferably 0.01 to 1 μm. The volume average particle diameter can be measured using, for example, a micro-track.

-Dispersion Liquid-

Then, supplemental components such as a dispersing medium and a surfactant used for preparing various dispersions, which are used upon manufacturing a toner, and a process for preparing those dispersions will be explained.

First, examples of a dispersing medium include an aqueous medium. Examples of the aqueous medium include water such as distilled water and ion exchanged water, and alcohols. These may be used alone, or two or more kinds may be used jointly.

It is preferable to add a surfactant to the aqueous medium and mixing them upon preparation of a dispersion.

Preferable examples of the surfactant include anionic surfactants such as a sulfate ester salt series, a sulfonate salt series, a phosphate series and a soap series; cationic surfactants such as an amine salt type, and a quaternary ammonium salt type; nonionic surfactants such as a polyethylene glycol series, an alkylphenol ethylene oxide adduct series, and a polyhydric alcohol series. Among them, ionic surfactants are preferable, and anionic surfactants and cationic surfactants are more preferable.

It is preferable that the nonionic surfactants are used with the anionic surfactants or cationic surfactants. The surfactants may be used alone, or two or more kinds may be used jointly.

Examples of the anionic surfactants include fatty acid soaps such as potassium laurate, sodium oleate, and castor oil sodium; sulfate esters such as octyl sulfate, lauryl sulfate, lauryl ether sulfate, and nonyl phenyl ether sulfate; sulfonate salts such as lauryl sulfonate, dodecyl sulfonate, dodecylbenzenesulfonate, sodium alkylnaphthalene sulfonate such as triisopropylnaphthalene sulfonate, and dibutylnaphthalene sulfonate, naphthalenesulfonate formalin condensate, monooctylsulfosuccinate, dioctylsulfosuccinate, lauric acid amide sulfoate, and oleic acid amide sulfonate; phosphate esters such as lauryl phosphate, isopropyl phosphate, and nonyl phenyl ether phosphate; sulfosuccinate salts such as sodium dialkylsulfosuccinate such as sodium dioctylsulfosiccinate, disodium lauryl sulfosuccinate, and disodium lauryl polyoxyethylene sulfosuccinate.

Examples of the cationic surfactants include amine salts such as laurylamine hydrochloride, stearylamine hydrochloride, oleylamine acetate, stearylamine acetate, and stearylaminopropylamine acetate; quaternary ammonium salts such as lauryltrimethylammonium chloride, dilauryldimethylammonium chloride, distearylammonium chloride, distearyldimethylammonium chloride, lauryldihydroxyethylmethylammonium chloride, oleylbispolyoxyethylenemethylammonium chloride, lauloylaminopropyldiemthylethylammmonium sulfate, lauroylaminopropyldimethylhydroxyetlhylammonium perchlorate, alkylbenzenedimethylammonium chloride, and alkyltrimethylammonium chloride.

Examples of the nonionic surfactants include alkyl ethers such as polyoxyethylene octyl ether, polyoxyethylene lauryl ether, polyoxyethylene stearyl ether, and polyoxyethylene oleyl ether, alkyl phenyl ethers such as polyoxyethylene octyl phenyl ether, and polyoxyethylene nonyl phenyl ether; alkyl esters such as polyoxyethylene laurate, polyoxyethylene stearate, and polyoxyethylene oleate, alkylamine such as polyoxyethylene laurylamino ether, polyoxyethylene stearylamino ether, polyoxyethylene oleylamino ether, polyoxyethylene soybeanaminoether, and polyoxyethylene tallowamino ether; alkylamides such as polyoxyethylene lauric acid amide, polyoxyethylene stearyl acid amide, and polyoxyethylene oleic amide, vegetable oil ethers such as polyoxyethylene castor oil ether, and polyoxyethylene rapeseed oil ether; alkanol amides such as lauric acid diethanolamide, stearic acid diethanol amide, and oleic acid diethanol amide; sorbitan ester ethers such as polyoxyethylene sorbitan monolaurate, polyoxyethylene sorbitan monopalmitate, polyoxyethylene sorbitan monostearate and polyoxyethylene sorbitan monooleate.

In an aggregating step, as already described, a mixed dispersion obtained by mixing at least a first resin fine particle dispersion and coloring agent dispersion is used. When a toner, which can perform so-called oilless fixation is prepared, it is preferable to further mix a releasing agent dispersion.

In a mixed dispersion in which these three kinds of dispersion are mixed, a content of first resin fine particles relative to a total solid matter is preferably 40% by mass or less, more preferably in a range of about 2 to 20% by mass. A content of a coloring agent is preferably 50% by mass or less, more preferably in a range of about 2 to 40% by mass. Further, a content of a releasing agent is preferably 50% by mass or less, more preferably in a range of about 5 to 40% by mass.

Further, when other internal additive component (particles) is added to a mixed dispersion in which three kinds of dispersion are mixed, a content of other internal additive component is generally sufficient as far as it is an extremely small amount. Specifically, a content of other internal additive component relative to a total solid matter contained in a mixed dispersion is preferably about 0.01 to 5% by mass, more preferably in a range of about 0.5 to 2% by mass.

A process for preparing various dispersions is not particularly limited, but a process appropriately selected depending on the object can be adopted. A dispersing means is not particularly limited, but examples of a usable apparatus include the known per se dispersing apparatus include a homomixer (Tokushu Kika Kogyo Co., Ltd.), a slusher (Mitsui mining Co., Ltd.), a Cabitron (Eurotech Co., Ltd.), a microfluidizer (MIZUHO Industrial Co., Ltd.), a Manton*Golin homogenizer (Golin Co.), a nanomizer (Nanomizer Co., Ltd.), and a static mixer (Noritake Company).

-Process for Preparing Toner-

Then, a process for preparing a toner comprising the aforementioned aggregating step, adhering step and fusing step will be explained in more detail in each step.

-Aggregating Step-

In an aggregating step, aggregated particles (core aggregated particles) in which particles consisting of each component are aggregated are formed by first adding an aggregating agent to a mixed dispersion obtained by mixing a first binder resin dispersion, a coloring dispersion and, if necessary, a releasing agent dispersion and other components, and heating at a temperature which is slightly lower than a melting point of a first binder resin. Alternatively, fused particles (core fused particles) may be formed by heating at a temperature not lower than a glass transition temperature of a first binder resin to perform aggregation and fusion at the same time.

Formation of aggregated particles is performed by adding an aggregating agent at room temperature, while the system is stirred with a rotation shear-type homogenizer. As an aggregating agent used in an aggregating step, in addition to a surfactant which has polarity reverse to that of a surfactant used as a dispersant for various dispersions, and an inorganic metal salt, a di- or more-valent metal complex can be preferably used.

In particular, when a metal complex is used, an amount of a surfactant to be used can be decreased, and charging property is improved, being particularly preferable.

Examples of the inorganic metal salt include metal salts such as calcium chloride, calcium nitrate, barium chloride, magnesium chloride, zinc chloride, aluminum chloride and aluminum sulfate, and inorganic metal salt polymers such as polyaluminum chloride, polyaluminum hydroxide, and calcium polysulfide. Inter alia, in particular, an aluminum salt and a polymer thereof are preferable. In order to obtain a sharper particle size distribution, divalent rather than monovalent, trivalent rather than divalent, and tetravalent rather than trivalent are more suitable as a valent number of an inorganic metal salt. And, even at the same valent number, a polymerization type inorganic metal salt polymer is more suitable.

-Adhering Step-

In an adhering step, a covering layer is formed by adhering resin fine particles comprising a second binder resin to a surface of core particles (core aggregated particles, or core fused particles) containing a first binder resin formed via the aforementioned aggregating step (hereinafter, aggregated particles having a core particle surface on which a covering layer is provided is referred to as "adhered resin aggregated particles"). Herein, this covering layer corresponds to a shell layer of the toner of the invention, which is formed via a fusing step described later. Formation of a covering layer can be performed by adding a second resin fine particle dispersion to a dispersion in which core particles have been formed in an aggregating step and, if necessary, other components may be additionally adhered at the same time.

The aforementioned added resin aggregated particles is uniformly adhered to a surface of the core particles to form a covering layer, and the adhered resin aggregated particles is heated and fused in a fusing step described later, whereby, resin fume particles comprising a second binder resin contained in a covering layer on a surface of core particles is melted to form a shell layer. For this reason, components such as a releasing agent contained in a core layer positioned on an internal side of a shell layer can be effectively prevented from exposing on a surface of a toner.

A method of adding and mixing a second resin fine particle dispersion in an adhering step is not particularly limited, but the method may be gradually performed continuously, or may be preformed step-wisely by dividing into plural times. Like this, by adding and mixing a second resin fine particle dispersion, production of fine particles can be suppressed, and a particle size distribution of the resulting toner can be made to be sharp.

This adhering step may be preformed once or plural times. In the former case, only one layer containing a second binder resin as a main component is formed on a surface of the core aggregated particles. To the contrary, in the latter case, when not only a second resin fine particle dispersion, but also a releasing agent dispersion, and a plurality of fine particle dispersions comprising other components are utilized, a layer containing a specific component as a main component is laminated and formed on a surface of core aggregated particles.

In the latter case, a toner having a complicated and precise stepwise-layered structure can be obtained, and this is advantageous in that desired function can be imparted to a toner. When the adhering step is performed a plurality of times, or preformed at a multiple step, a composition and physical property from a surface to an interior of the resulting toner can be changed step-wisely, and a structure of a toner can be easily controlled. In this case, a plurality of layers are laminated step-wisely on a surface of core particles, and a structural change or a compositional gradient can be imparted, and physical property can be changed from an interior to an exterior of toner particles. In addition, in this case, a shell layer corresponds to all layers, which are laminated on a surface of core particles, and an outermost layer is constructed of a layer containing a second binder resin as a main component. In the following explanation, explanation will be performed on a premise of the case where an adhering step is only once.

The condition under which resin fine particles comprising a second binder resin is adhered to the core particles is as follows. That is, as a heating temperature at an adhering step, a temperature near a melting point of a first binder resin contained in core aggregated particles is preferable and, specifically, a temperature range within ±10° C. from a melting point is preferable.

When the system is heated at a temperature lower than a melting point of a first binder resin by over 10° C., it becomes difficult to adhere resin fine particles comprising a first binder resin present onto a surface of core particles, and resin fine particles comprising a second binder resin adhered to a surface of core aggregated particles and, as a result, a thickness of a formed shell layer becomes un-uniform in some cases.

On the other hand, when the system is heated at a temperature higher than a melting point of a first binder resin by over 10° C., it becomes easy to adhere resin fine particles comprising a first binder resin present on a surface of core particles, and resin fine particles comprising a second binder resin adhered to a surface of core particles.

However, since adherability is enhanced too much, adhesion between adhered resin aggregated particles also occurs, and a particle diameter/particle size distribution of the resulting toner is also disintegrated. A heating time in an adhering step depends on a heating temperature and cannot be primarily defined, but is usually around 5 minutes to 2 hours.

In an adhering step, a dispersion obtained by adding a second resin fine particle dispersion to a mixed solution in which core particles are formed may be allowed to stand, or may be stirred mildly with a mixer. The latter case is advantageous in that uniform adhered resin aggregated particles are easily formed.

-Fusing Step-

In a fusing step, adhered resin aggregated particles obtained in an adhering step are fused by heating them. A fusing step can be performed at a temperature, which is higher of glass transition temperatures of a first binder resin or a second binder resin whichever is higher. A fusing time may be shorter when a heating temperature is higher, and needs a longer time when a heating temperature is lower. That is, a fusing time depends on a heating temperature, and cannot be indiscriminately defined, but is generally 30 minutes to 10 hours.

In a fusing step, when two kinds of binder resins are heated over a melting point, a cross-linking reaction may be preformed at the same time, or after fusion is completed, a cross-linking reaction may be performed. When a cross-linking reaction is performed, for example, an unsaturated sulfonated crystalline polyester resin copolymerized with a double bond component as a binder resin can be used. Upon a cross-linking reaction, a cross-linking structure is introduced by causing a radical reaction in a binder resin having such the cross-linking reactivity. Thereupon, the following polymerization initiators are used.

Examples of the polymerization initiator include t-butylperoxy-2-ethyl hexanoate, cumyl perpivalate, t-butyl peroxylaurate, benzoyl peroxide, lauroyl peroxide, octanoyl peroxide, di-t-butyl peroxide, t-butylcumyl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(t-butylperoxy) 3,3,5-trimethylcyclohexane, 1,1-bis(t-butylperoxy)cyclohexane, 1,4-bis(t-butylperoxycarbonyl) cyclohexane, 2,2-bis(t-butylperoxy)octane, n-butyl 4,4-bis(t-butylperoxy)valerate, 2,2-bis(t-butylperoxy)butane, 1,3-bis (t-butylperoxyisopropyl)benzene, 2,5-dimethyl-2,5-di(t-butylperoxy)hexane, 2,5-dimethyl-2,5-di(t-butylperoxy) hexane, 2,5-dimethyl-2,5-di(benzoylperoxy)hexane, di-t-butyl diperoxyisophthalate, 2,2-bis(4,4-di-t-butylperoxycyclohexyl)propane, di-t-butylperoxy α-methylsuccinate, di-t-butylperoxydimethyl glutarate, di-t-butyl peroxyhexahydroterephthalate, di-t-butyl peroxyazelate, 2,5-dimethyl-2,5-di(t-butylperoxy)hexane, diethylene glycol-bis(t-butylperoxycarbonate), di-t-butyl peroxytrimethyladipate, tris(t-butylperoxy)triazine, vinyl tris(t-butylperoxy)silane, 2,2'-azobis(2-methylpropionamidine dihydrochloride), 2,2'-azobis[N-(2-carboxyethyl)-2-methylpropionamidine], and 4,4'-azobis(4-cyanowaleric acid). These polymerization initiators may be used alone, or two or more kinds may be used jointly. An amount and a kind of a polymerization initiator are selected depending on an amount of an unsaturated part in a binder resin, and a kind and an amount of a coexisting coloring agent.

A polymerization initiator may be mixed into a binder resin component in advance before an emulsification step of preparing a resin fine particle dispersion, or may be incorporated into core particles formed in an aggregating step. Further, a polymerization initiator may be introduced at a fusing step or after a fusing step. When a polymerization initiator is introduced at an aggregating step, an adhering step, or a fusing step, or after a fusing step, a solution in which a polymerization initiator is dissolved or emulsified is added to a dispersion (resin fine particle dispersion) used in each step. For the purpose of controlling a polymerization degree, the known cross-linking agent, chain transfer agent, and polymerization inhibitor may be added to these polymerization initiators.

When core particles are core fused particles, resin fine particles comprising a second binder resin may be adhered. In this case, dispersion containing core fused particles is once filtered to control a moisture rate of a dispersion to 30% by mass to 50% by mass, and a second resin fine particle dispersion is added. Thereby, fine particles comprising a second binder resin are adhered to a surface of core fused particles.

When a moisture rate of a dispersion is lower than 30% by mass, adherability of fine particles comprising a second binder resin may be worse, and the fine particles is freed from core fused particles in some cases. On the other hand, when a moisture rate is higher than 50% by mass, stirring may become difficult, and fine particles comprising a second binder resin is not uniformly adhered to a surface of core fused particles in some cases.

By applying a mechanical stress due to a Henschel mixer to adhered resin aggregated particles obtained by adhering fine particles comprising a second binder resin to a surface of core fused particles after completion of a washing/drying step described later, fine particles comprising a second binder resin adhered to a surface of core fused particles can be fused. Like this, by applying a mechanical stress in place of heating in a liquid phase, a fusing step may be performed.

-Washing/Drying Step-

Fused particles obtained via a fusing step are subjected to solid liquid separation such as filtration, washing, and drying. Thereby, a toner in the state where an external additive is not added is obtained.

The solid liquid separation is not particularly limited, but suction filtration and pressure filtration are preferable from a viewpoint of productivity. It is preferable that the washing is sufficiently performed by substitution washing with ion exchanged water from a viewpoint of charging property. In a drying step, an arbitrary method such as a conventional vibration-type flowing drying method, spray drying method, lyophilizing method, and flash jet method can be adopted. It is desirable to adjust a moisture rate of toner particles after drying preferably to 1.0% by mass or lower, more preferably 0.5% by mass or lower.

In toner particles granulated via a drying step as described above, as other component, the known additives can be used by appropriate selection depending on the object. Specifically, examples include the known various additives such as inorganic fine particles, organic fine particles, charge controlling agents, and releasing agents.

Examples of the inorganic fine particles include silica, alumina, titanium oxide, barium titanate, magnesium titanate, calcium titanate, strontium titanate, zinc oxide, silica sand, clay, mica, wollastonite, diatomaceous earth, cerium chloride, red iron oxide, chromium oxide, cerium oxide, antimony trioxide, magnesium oxide, zirconium oxide, silicon carbide, and silicon nitride. Among them, silica fine particles are preferable, and hydrophobicized silica fine particles is preferable.

The inorganic fine particles are generally used for improving flowability. Among the aforementioned inorganic fine particles, metatitanic acid $TiO(OH)_2$ does not influence on transparency, and can provide a developer which is excellent in better charging property, environmental stability, flowability, caking resistance, stable negative charging property, and stable image quality maintenance.

It is preferable that hydrophobicized metatitanic acid compounds have an electric resistance of $10^{10}$ Ω·cm or higher. This is because, when a toner in which hydrophobicized metatitanic acid has been externally addition-treated is used, even when a transference electric field is raised, high transferring property can be obtained without occurrence of a toner, which is charged to reverse polarity.

Examples of the organic fine particles include polystyrene, polymethyl methacrylate, and polyvinylidene fluoride. The organic fine particles are generally used for the purpose of improving cleanability and transferring property.

A number average particle diameter of the inorganic fine particles and the organic fine particles is preferably 80 nm or less, more preferably 50 nm or less. When monodisperse spherical silica or monodisperse spherical organic resin fine particles is used as an external additive, a median diameter of these external additives is preferably not less than 0.1 μm and less than 0.3 μm from a viewpoint of improvement and maintenance of a transferring efficiency.

Examples of the electrification controlling agent include a salicylic acid metal salt, a metal-containing azo compound, nigrosine and a quaternary ammonium salt. The charge controlling agent is generally used for the purpose of improving charging property.

In the invention, the external additive is added to toner particles, and the materials are mixed. Mixing can be performed with the known mixing machine such as a V-type blender, a Henschel mixer, and a Ledige mixer. Thereupon, if necessary, various additives may be added. Examples of the additive include other flowing agent, and a cleaning aid and a transference aid such as polystyrene fine particles, polymethyl methacrylate fine particles, and polyvinylidene fluoride fine particles.

In the invention, the state of adhesion of the inorganic compound to a surface of toner particles may be simple mechanical adhesion, or may be loose adhesion to a surface. In addition, an entire surface of toner particles may be covered, or a part of the surface may be covered. An addition amount of the external additive is preferably in a range of 0.3 to 3 parts by mass, more preferably in a range of 0.5 to 2 parts by mass relative to 100 parts by mass of toner particles.

When an addition amount is less than 0.3 parts by mass, flowability of a toner is not sufficiently obtained in some cases, and blocking suppression due to storage under high temperature environment may easily become insufficient. On the other hand, an addition amount is more than 3 parts by mass, the state where the surface is excessively covered is realized. For this reason, excessive inorganic oxide, which has been externally added to a surface of toner particles is transferred onto a member contacting with a toner, causing secondary disorder in some cases. Alternatively, a toner may be passed through a sieving process after mixing with an external additive.

The toner of the invention can be preferably prepared by the above-explained process, but the process is not limited to such the process.

<Developer for Electrostatic Charge Image Developing>

The developer for electrostatic charge image developing of the invention (hereinafter, abbreviated as "developer" in some cases) can be used as one component developer comprising only of the toner of the invention, or a two-component developer comprising of the present toner and a carrier.

A carrier which can be used in a two component developer is not particularly limited, but the known carrier can be used. As the carrier, a resin coating carrier having a resin covering layer in which an electrically conductive material is dispersed in a matrix resin, on a core material surface, can be utilized. Since a volume specific resistance of a resin coating carrier is not greatly changed even when a resin covering layer is peeled, high image quality can be maintained for a long period of time.

Examples of the matrix resin include polyethylene, polypropylene, polystyrene, polyacrylonitrile, polyvinyl acetate, polyvinyl alcohol, polyvinyl butyral, polyvinyl chloride, polyvinylcarbazole, polyvinyl ether, polyvinyl ketone, vinyl chloride-vinyl acetate copolymer, styrene-acrylic acid copolymer, a straight silicone resin comprising an organosiloxane resin or a modified product thereof, a fluorine resin, polyester, polyurethane, polycarbonate, a phenol resin, an amino acid resin, a melamine resin, a benzoguanamine resin, a urea resin, an amide resin, and an epoxy resin, being not limiting.

Examples of the electrically conductive material include metals such as gold, silver and copper, titanium oxide, zinc oxide, barium sulfate, aluminum borate, potassium titanate, tin oxide, and carbon black, being not limiting. A content of the electrically conductive material is preferably in a range of 1 to 50 parts by mass, more preferably in a range of 3 to 20 parts by mass relative to 100 parts by mass of a matrix resin.

Examples of a core material of a carrier include a magnetic powder alone, or a core material obtained by finely-dividing a magnetic powder, and dispersing this in a resin. Examples of a method of finely-dividing a magnetic powder, and dispersing this in a resin include a method of kneading a resin and a magnetic powder, and grinding this, a method of melting a resin and a magnetic powder, and spray drying it, and a method of polymerizing a magnetic powder-contained resin in a solution using a polymerization process. From a viewpoint of controlling of a true gravity of a carrier, and shape controlling, it is preferable to use a core material of a magnetic powder dispersion-type by a polymerization process in that a free degree is high.

The carrier contains a magnetic powder of fine particles preferably at 80% by mass or more relative to a total weight of a carrier in that a carrier is not easily flown to the air. Examples of the magnetic material (magnetic powder) include magnetic metals such as iron, nickel and cobalt, and magnetic oxides such as ferrite and magnetite. A volume average particle diameter of the core material is generally in a range of 10 to 500 μm, preferably in a range of 25 to 80 μm.

Examples of a method of forming the resin covering layer on a surface of a core material of a carrier include an immersion method of immersing a carrier core material in a solution for forming a covering layer containing the matrix resin, an electrically conductive material and a solvent, a spray method of spraying a solution for forming a covering layer to a surface of a carrier core material, a fluidized bed method of spraying a solution for forming a covering layer in the state where a carrier core material is floated by the flowing air, and a kneader coater method of mixing a carrier core material and a covering layer forming solution in a kneader coater, and removing the solvent.

The solvent used in the solution for forming a covering layer is not particularly limited as far as it dissolves the matrix resin, but for example, aromatic hydrocarbons such as toluene and xylene, ketones such as acetone and methyl ethyl ketone, and ethers such as tetrahydrofuran and dioxane can be used. An average film thickness of the resin covering layer is usually in a range of 0.1 to 10 μm, but in the invention, in order to manifest a stable volume specific resistance of a carrier with time, the thickness is preferably in a range of 0.5 to 3 μm.

In order to attain high quality image, a volume specific resistance of a carrier used in the invention is preferably in a range of $10^6$ to $10^{14}$ Ω·cm, more preferably in a range of $10^8$ to $10^{13}$ Ω·cm at 1,000V corresponding to upper and lower limits of a conventional developing contrast potential. When a volume specific resistance of a carrier is less than $10^6$ Ω·cm, reproducibility of a fine wire may be worse, and toner fog easily occurs on a background part due to injection of a charge, in some cases. On the other hand, when a volume specific resistance of a carrier is greater than $10^{14}$ Ω·cm, reproducibility of black plain, and half tone is deteriorated in some cases. In addition, an amount of a carrier, which transfers to an image carrying body (photoreceptor) may be increased, easily damaging a photosensitive body.

The developer of the invention is preferably such that the aforementioned toner of the invention is mixed and adjusted in a range of 3 to 15 parts by mass relative to 100 parts by mass of the carrier.

<Image Forming Apparatus>

Then, the image forming apparatus of the invention will be explained. The image forming apparatus of the invention is not particularly limited as far as it is an electrophotography manner image forming apparatus using the toner of the invention and, specifically, it is preferable that the apparatus has the following construction.

That is, it is preferable that the image forming apparatus of the invention comprises an image carrying body, an charging means of charging a surface of the image carrier body, an exposing means of forming an electrostatic latent image on a surface of the aforementioned charged image carrying body depending on image information, a developing means of developing the electrostatic latent image with a developer containing a toner, a developing means of forming a toner image on a surface of the image carrying body, a transferring means of transferring the toner image onto a surface of a recording medium from a surface of the image carrying body, and a fixing means of fixing the toner image transferred onto a surface of the recording medium by heating and pressing to form an image. A toner used in this case is the toner of the invention.

Since the toner of the invention has the aforementioned effects, it is preferable that the image forming apparatus of the invention is provided with (1) an image forming apparatus having waiting term power saving function, (2) an image forming apparatus having a smaller heat capacity of a fixing machine (generally, a compact image forming apparatus having a volume of 0.8 $m^3$ or less), (3) an image forming apparatus having a low fixing temperature, or any two or more of (1) to (3).

A fixing means (fixing machine) contains a heating means such as a halogen lamp having at least function of heating a toner image. Herein, waiting term power saving function refers to function of maintaining a temperature (or consumed electric power of a heating means) at a heating means or a nip part fixing a toner image, at a temperature (or consumed electric power of a heating means) lower than a temperature at fixation when the state where an image is not formed, continues (so-called waiting state).

When the image forming apparatus of the invention is an image forming apparatus having waiting term power saving function, a set temperature for controlling a fixation temperature at a nip part has a difference between at waiting and at image formation (at fixation) of preferably 10° C. or more, more preferably a difference of 20° C. or more, further preferably a difference of 25° C. or more. From a practical viewpoint such as preventing a time necessary for warming up from being longer than as necessary, a difference in a set temperature between at waiting and at image formation (at fixation) is preferably 30° C. or less.

In an apparatus having a greater difference in a set temperature between at waiting and at image formation, energy saving effect becomes greater, while initial over shoot also becomes greater. For this reason, even when an image is continuously formed, scatter of a tone (color developing property) between images formed in each sheet may easily become great. However, when the toner of the invention is used in an apparatus in which a difference in a set temperature between at waiting and at image formation, scatter of a tone (color developing property) between images formed in each sheet can be easily suppressed.

A set temperature means a temperature determined using, as a standard, a temperature sensed by a temperature sensor provided at a prescribed position such as a nip part and a heating means such as a halogen heater, in order to control a fixation temperature at a nip part, at fixation. Herein, when a temperature sensor utilized for determining a set temperature is provided on a nip part, a set temperature at fixation can be substantially regarded as an average of an actual fixation temperature.

In addition, when the image forming apparatus of the invention is an image forming apparatus having a low fixation temperature, an average of an actual fixation temperature (actual average fixation temperature) at a nip part at fixation is preferably 120° C. or lower, more preferably 110° C. or lower, further preferably 100° C. or lower. When an actual average fixation temperature is too low, since it becomes difficult to melt a toner, practically, the average is preferably 90° C. or higher.

As an actual average fixation temperature becomes lower, energy saving effect becomes larger, while scatter of a tone (color developing property) between images formed in each sheet when an image is continuously formed may easily become large. However, when the toner of the invention is used also in an apparatus satisfying the aforementioned condition, scatter of a tone (color developing property) between images formed in each sheet can be easily suppressed.

An actual average fixation temperature means an average temperature at a nip part of a fixing machine at fixation. In this case, in an image forming apparatus in which a temperature at a nip part is monitored, and a heating means such as a halogen heater in a fixing machine is controlled, substantially, a set temperature for controlling a heating means can be regarded as an actual average fixation temperature.

EXAMPLE

The invention will be explained below by way of Examples, but the invention is not limited to these Examples.

-Preparation of Binder Resin Fine Particle Dispersion (1)-

| | |
|---|---|
| Styrene: | 300 parts by mass |
| n-butyl acrylate: | 190 parts by mass |
| Acrylic acid: | 3 parts by mass |
| Dodecanethiol: | 24 parts by mass |
| Carbon tetrabromide: | 4 parts by mass |

A solution in which the above components were mixed and dissolved was added to a solution in which 6 parts by mass of a nonionic surfactant (Nonipol 400, manufactured by Sanyo Chemical Industries, Ltd.) and 10 parts by mass of an anionic surfactant (Neogen SC, manufactured by Dai-ichi Kogyo Seiyaku Co., Ltd.) were dissolved in 560 parts by mass of ion exchanged water, the materials were dispersed and emulsified in a flask, 50 parts by mass of ion exchanged water in which 4 parts by mass of ammonium persulfate were dissolved was further added, and nitrogen replacement was performed. Subsequently, the content was heated with an oil bath until 70° C. while an interior of the flask is stirred, and emulsion polymerization was continued as it was for 5 hours.

Thus, a binder resin fine particle dispersion (1) in which a binder resin having a volume average particle diameter of 180 nm and a weight average molecular weight (Mw) of 28,000 was dispersed, was prepared. A moisture amount is adjusted so that a resin fine particle concentration of this dispersion became 10% by mass. A SP value of this binder resin obtained by calculation was 9.93.

-Binder Resin Fine Particle Dispersion (2)-

A heated and dried three-neck flask was charged with 98.0 mol % of 1,8-sebacindioic acid, 2.0 mol % of dimethyl isophthalate—sodium 5-sulfonate as an acid component, 100 mol % of 1,6-hexanediol, and $Ti(OBu)_4$ (0.014% by mass relative to an acid component) as a catalyst, the air in a container was evacuated by evacuating operation, the inert atmosphere was realized by a nitrogen gas, and refluxing is performed at 180° C. for 6 hours by mechanical stirring.

Thereafter, excessive ethylene glycol was removed by distillation under reduced pressure, a temperature was gradually raised to 220° C., the reaction was stirred for 4 hours and, at the viscous state, a molecular weight was confirmed by GPC (gel permeation chromatography) and, at a weight average molecular weight of 28,000, distillation under reduced pressure was stopped, and the material is cooled with the air to obtain a binder resin. An acid value was 9.8 mgKOH/g.

Then, this resin in the melt state was transferred to Cabitron CD 1010 (manufactured by Euroteck) at a rate of 100 g per minute. A separately prepared aqueous medium tank was charged with dilute aqueous ammonia having a concentration of 0.37% by mass obtained by diluting reagent aqueous ammonia with ion exchanged water, and this was transferred to Cabitron at the same time with the resin in the melt state at a rate of 0.1 liter per minute while the material was heated to 120° C. with a heat exchanger.

By operating Cabitron under the condition of a rotation rate of a rotor of 60 Hz at a pressure of 5 $Kg/cm^2$ in this state, a binder resin dispersion (2) having a volume average particle diameter of 0.38 μm was obtained. A moisture amount was adjusted so that a resin fine particle concentration of this dispersion becomes 10% by mass. A SP value of this resin obtained by calculation was 9.34.

-Preparation of Binder Resin Fine Particle Dispersion (3)-

| | |
|---|---|
| Bisphenol A - ethylene oxide adduct (average addition mole number 2.1): | 85 parts by mass |
| Bisphenol A - propylene oxide adduct (average addition mole number 2.2): | 217 parts by mass |
| Fumaric acid: | 80 parts by mass |
| Terephthalic acid: | 49 parts by mass |

Into a solution in which the above components were mixed and dissolved was placed 0.12 g of dibutyltin oxide as a catalyst, the air in a container was then evacuated by evacuating operation, the inert atmosphere was realized by a nitrogen gas, and refluxing was performed at 120° C. for 6 hours by mechanical stirring.

Thereafter, a temperature was gradually raised to 200° C. by distillation under reduced pressure, the reaction was stirred for 5 hours and, at the viscous state, a molecular weight was confirmed by GPC and, at a weight average molecular weight of 10,000, distillation under reduced pressure was stopped, and the system was cooled with the air to obtain a binder resin. Then, this in the melt state was transferred to Cabitron CD 1010 (manufactured by Euroteck Co. Ltd.) at a rate of 100 g per minute. A separately prepared aqueous medium tank was charged with dilute aqueous ammonia having a concentration of 0.37% by mass obtained by diluting reagent aqueous ammonia with ion exchanged water, and this was transferred to the Cabitron at the same time with the melting body of a binder resin at a rate of 0.1 liter per minute while the solution was heated to 120° C. with a heat changer.

Cabitron was operated under the condition of a rotation rate of a rotor of 60 Hz and a pressure of 5 Kg/cm$^2$ in this state, to obtain a resin fine particle dispersion (3) containing binder resin fine particles having a volume average particle diameter of 0.14 μm. A moisture amount was adjusted so that a resin fine particle concentration of this dispersion became 10% by mass. A SP value of this resin obtained by calculation was 10.01.

-Preparation of Binder Resin Fine Particle Dispersion (4)-

| | |
|---|---|
| Bisphenol A - propylene oxide adduct (average addition mole number 2.2): | 282 parts by mass |
| Isophthalic acid: | 82 parts by mass |
| Terephthalic acid: | 82 parts by mass |

According to the same manner as that of preparation of the binder resin fine particle dispersion (3) except that the above materials were used, a binder resin having a weight average molecular weight of 8,500 was obtained. Then, this was emulsified and dispersed with Cabitron under the same condition as that of preparation of the binder resin fine particle dispersion (3) to obtain a binder resin fine particle dispersion (4) comprising a polyester resin having a volume average particle diameter of 0.10 μm. A moisture amount was adjusted so that a resin fine particle concentration of this dispersion becomes 10% by mass. A SP value obtained by calculation of this binder resin was 10.50.

-Preparation of Binder Resin Fine Particle Dispersion (5)-

| | |
|---|---|
| Styrene: | 410 parts by mass |
| n-butyl acrylate: | 50 parts by mass |

-continued

| | |
|---|---|
| Acrylic acid: | 3 parts by mass |
| Dodecanethiol: | 6 parts by mass |
| Carbon tetrabromide: | 4 parts by mass |

A solution in which the above components were mixed and dissolved was emulsified and dispersed in a solution in which 6 parts by mass of a nonionic surfactant (Nonipol 400, manufactured by Sanyo Kogyo Industries, Ltd.) and 12 parts by mass of an anionic surfactant (Neogen SC, manufactured by Dai-ichi Kogyo Seiyaku Co., Ltd.) were dissolved in 550 parts by mass of ion exchanged water in a flask, and 50 parts by mass of ion exchanged water in which 3 parts by mass of ammonium persulfate were dissolved was further added while the system was slowly mixed for 10 minutes. Subsequently, the flask was replaced with nitrogen, a solution in a flask was heated with an oil bath to 65° C. while the solution was stirred, and emulsion polymerization was continued as it was for 7 hours.

As a result, a binder resin fume particle dispersion (5) in which a binder resin having a volume average particle diameter of 200 nm and a weight average molecular weight Mw of 39,000 was dispersed was obtained. A moisture amount is adjusted so that a resin fine particle concentration of this dispersion became 10% by mass. A SP value of this binder resin obtained by calculation was 10.07.

-Preparation of Binder Resin Fine Particle Dispersion (6)-

| | |
|---|---|
| Styrene: | 240 parts by mass |
| n-butyl acrylate: | 210 parts by mass |
| Acrylic acid: | 3 parts by mass |
| Dodecanethiol: | 24 parts by mass |
| Carbon tetrabromide: | 4 parts by mass |

A solution in which the above components were mixed and dissolved was added to a solution in which 6 parts by mass of a nonionic surfactant (Nonipol 400, manufactured by Sanyo Kogyo Industries, Ltd.) and 12 parts by mass of an anionic surfactant (Neogen SC, manufactured by Dai-ichi Kogyo Seiyaku Co., Ltd.) were dissolved in 540 parts by mass of ion exchanged water, this was dispersed and emulsified in a flask, 50 parts by mass of ion exchanged water in which 5 parts by mass of ammonium persulfate were dissolved is further added while the system was slowly mixed for 10 minutes, and nitrogen replacement was performed. Subsequently, the flask was heated with an oil bath until a content becomes 75° C. while the flask was stirred, and emulsion polymerization was continued for 5 hours.

Thus, a binder resin fine particle dispersion (6) in which a binder resin having a volume average particle diameter of 192 nm and a weight average molecular weight (Mw) of 31,000 was dispersed is prepared. A moisture amount was adjusted so that a resin fine particle concentration of this dispersion became 10% by mass. A SP value of this binder resin obtained by calculation was 9.89.

-Preparation of Binder Resin Fine Particles Dispersion (7)-

| | |
|---|---|
| Bisphenol A - propylene oxide adduct (average addition mole number 2.2): | 400 parts |
| Trimethylolpropane: | 400 parts |
| Terephthalic acid: | 1,600 parts |

According to the same manner as that of preparation of the binder resin fine particle dispersion (3) except that the above materials were used, a binder resin having a weight average molecular weight of 23,000 was obtained. Then, this is emulsified and dispersed with Cabitron under the same condition as that of preparation of the binder resin fine particle dispersion (3), to obtain a binder resin fine particle dispersion (7) comprising a polyester resin having a volume average particle diameter of 0.38 μm. A moisture amount was adjusted so that a resin fine particle concentration of this dispersion becomes 10% by mass. A SP value of this binder resin obtained by calculation was 10.21.

-Preparation of Releasing Agent Dispersion-

| | |
|---|---|
| Paraffin wax (HNP 9, manufactured by Nippon Seiro Co., Ltd., melting point 77° C.): | 60 parts by weight |
| Anionic surfactant (Neogen RK, manufactured by Dai-ichi Kogyo Seiyaku Co., Ltd.): | 4 parts by weight |
| Ion exchanged water: | 200 parts by mass |

A solution in which the above components were mixed was heated to 120° C., dispersed using a homogenizer (Ultra Turrax T50, manufactured by IKA Co.), and subjected to dispersing treatment with a Manton Golin high pressure homogenizer (Golin Co.) to prepare a releasing agent dispersion in which a releasing agent having a volume average particle diameter of 250 nm was dispersed. A moisture amount was adjusted so that a releasing agent concentration of this dispersion becomes 10% by mass.

-Preparation of Coloring Agent Dispersion (1)-

| | |
|---|---|
| Cyan pigment (copper phthalocyanine B 15:3, manufactured by Dainichiseika Color & Chemicals Mfg. Co., Ltd.): | 50 parts by mass |
| Nonionic surfactant (Nonipol 400, manufactured by Kao Corporation): | 5 parts by mass |
| Ion exchanged water: | 200 parts by mass |

The above components were mixed and dissolved, and dispersed for about 1 hour using a high pressure impact manner dispersing machine Altimizer (HJP 30006, manufactured by Sugino Machine Co., Ltd.), and a moisture weight was adjusted to obtain a coloring agent particle dispersion (1).

-Preparation of Coloring Agent Dispersion (2)-

| | |
|---|---|
| Yellow pigment (C.I. Pigment Yellow 180): | 50 parts by mass |
| Nonionic surfactant (Nonipol 4001, manufactured by Kao Corporation): | 5 parts by mass |
| Ion exchanged water: | 200 parts by mass |

The above components were mixed and dissolved, and dispersed for about 6 hours using a high pressure impact manner dispersing machine Altimizer (HJP 30006, manufactured by Sugino Machine Co., Ltd.), and a moisture weight was adjusted to obtain a coloring agent particle dispersion (2).

-Preparation of Toner Mother Particle (1)-

| | |
|---|---|
| Binder resin fine particle dispersion (1): | 720 parts by mass |
| Coloring agent dispersion (1): | 50 parts by mass |

-continued

| | |
|---|---|
| Releasing agent dispersion (1): | 70 parts by mass |
| Cationic surfactant (Sanizol B50, manufactured by Kao Corporation): | 1.5 parts by mass |

The above components were accommodated in a round-type stainless flask, and 14 parts by mass of an aqueous nitric acid solution having a polyaluminum chloride concentration of 10% by mass was added as an aggregating agent.

Thereafter, the materials were dispersed at 30° C. using a homogenizer (Ultra Turrax T50, manufactured by IKA Co.), and then the dispersion was heated to 40° C. in a heating oil bath. A volume average particle diameter of the resulting core aggregating particles was measured with a Coulter counter (TA2 type, manufactured by Coulter Co.) and was found to be 5.5 μm.

After this aggregating particle dispersion was retained at 40° C. for 30 minutes, 160 parts by mass of a binder resin fine particle dispersion (4) was slowly added to the dispersion in which core aggregated particles were formed, and this is retained for 1 hour. A volume average particle diameter of the resulting adhered resin aggregated particles was measured using a Coulter counter (TA2 type, manufactured by Coulter Co.) and was found to be 5.8 μm. This was heated to 80° C. while stirring is further continued, and retained for 3 hours.

Thereafter, this was cooled to 20° C. at a rate of 1° C./min, filtered, washed with ion exchanged water, and dried using a vacuum drier to obtain toner mother particles having a core shell structure. A volume average particle diameter of the resulting toner mother particles was measured using a Coulter counter (TA2 type, manufactured by Coulter Co.) and was found to be 5.7 μm.

-Preparation of Toner Mother Particles (2)-

| | |
|---|---|
| Binder resin fine particle dispersion (1): | 680 parts by mass |
| Coloring agent dispersion (2): | 100 parts by mass |
| Releasing agent dispersion (1): | 70 parts by mass |
| Cationic surfactant (Sanizol B50, manufactured by Kao Corporation): | 1.5 parts by mass |

According to the same manner as that of the toner mother particles (1) except that the aforementioned respective dispersions were used for forming core aggregated particles, toner mother particles of a volume average particle diameter of 6.3 μm having a core shell structure was prepared.

-Preparation of Toner Mother Particles (3)-

| | |
|---|---|
| Binder resin fine particle dispersion (2): | 150 parts by mass |
| Binder resin fine particle dispersion(3): | 500 parts by mass |
| Binder resin fine particle dispersion (7): | 30 parts by mass |
| Coloring agent dispersion (1): | 50 parts by mass |
| Releasing agent dispersion (1): | 70 parts by mass |
| Cationic surfactant (Sanizol B50, manufactured by Kao Corporation): | 1.5 parts by mass |

The above components were placed into a round stainless flask, and 16 parts by mass of an aqueous nitric acid solution having a polyaluminum chloride concentration of 10% by weight was added as an aggregating agent. Thereafter, the materials were dispersed at 30° C. using a homogenizer (Ultra Turrax T50, manufactured by IKA Co.), and this was heated to 45° C. in a heating oil bath. A volume average diameter of the resulting core aggregated particles was measured using a Coulter counter (TA2 type, manufactured by Coulter Co.), and was found to be 5.2 μm.

Further, the dispersion was heated to 95° C. while stirring was continued, and retained for 2 hours to fuse core aggregated particles to obtain core fuse particles. Thereafter, this was cooled to 25° C. at a rate of 20° C./min, and filtered to adjust to a moisture rate of 35% by mass. To the dispersion containing the core fused particles having a moisture rate of 35% by mass was added slowly 200 parts by mass of a binder resin fine particle dispersion (4), 32parts by mass of aqueous nitric acid solution having a polyaluminum chloride concentration of 10% by mass was added while stirring was performed, and retained for 240 minutes. The resulting adhered resin aggregating particles were washed with ion exchange water, and dried using a vacuum drier.

Further, the adhered resin aggregated parts are stirred for 20 minutes with a Henschel mixer to fuse them, to obtain toner mother particles having a core shell structure. A volume average particle diameter of the toner mother particles was measured using a Coulter counter (TA2 type, manufactured by Coulter Co.), and was found to be 6.9 μm.

-Preparation of Toner Mother Particles (4)-

| | |
|---|---|
| Binder resin fine particle dispersion (2): | 150 parts by mass |
| Binder resin fine particle dispersion (3): | 480 parts by mass |
| Coloring agent dispersion (2): | 100 parts by mass |
| Releasing agent dispersion (1): | 70 parts by mass |
| Cationic surfactant (Sanizol B50, manufactured by Kao Corporation): | 1.5 part by mass |

According to the same manner as that of the toner mother particles (3) except that the above respective dispersions were used for forming core aggregated particles to prepare fused particles having a volume average diameter of 6.8 μm.

-Preparation of Toner Mother Particles (5)-

| | |
|---|---|
| Binder resin fine particle dispersion (1): | 560 parts by mass |
| Coloring agent dispersion (1): | 50 parts by mass |
| Releasing agent dispersion (1): | 70 parts by mass |
| Cationic surfactant (Sanizol B50, manufactured by Kao Corporation): | 1.5 parts by mass |

The above components were accommodated in a round stainless flask, and 14 parts by mass of an aqueous nitric acid solution having a polyaluminum chloride concentration of 10% by weight was added as an aggregating agent. Thereafter, this was dispersed at 30° C. using a homogenizer (Ultra Turrax T50, manufactured by IKA Co.), and the dispersion was heated to 40° C. in a heating oil bath. A volume average particle diameter of the resulting aggregated particle was measured using a Coulter counter (TA2 type, manufactured by Coulter Co.), and was found to be 5.6 μm.

The dispersion in which the aggregated particles were formed is retained at 40° C. for 30 minutes, to the dispersion was added slowly 320 parts by mass of a binder resin fine particle dispersion (5), and this was retained for 3 hours.

A volume average particle diameter of the resulting adhered resin aggregated particles was measured using a Coulter counter (TA2 type, manufactured by Coulter Co.), and was found to be 6.3 μm. Further, the dispersion was heated to 95° C. while stirring was continued, and retained for 5 hours. Thereafter, this was cooled to 20° C. at a rate of 1° C./min, filtered, washed with ion exchange water, and dried with a vacuum drier to obtain toner mother particles having a core shell structure.

A volume average particle diameter of the resulting toner mother particles using a Coulter counter (TA2 type, manufactured by Coulter Co.), and was found to be 6.2 μm.

-Preparation of Toner Mother Particles (6)-

| | |
|---|---|
| Binder resin fine particle dispersion (1): | 510 parts by mass |
| Coloring agent dispersion (2) | 100 parts by mass |
| Releasing agent dispersion (2): | 70 parts by mass |
| Cationic surfactant (Sanizol B50, manufactured by Kao Corporation): | 1.5 parts by mass |

According to the same manner as that of the toner mother particles (5) except that the aforementioned respective dispersion were used for forming core aggregated particles, toner mother particles of a volume average particle diameter of 5.9 μm having a core shell structure was obtained.

-Preparation of Toner Mother Particles (7)-

| | |
|---|---|
| Binder resin fine particle dispersion (2): | 350 parts by mass |
| Coloring agent dispersion (1): | 50 parts by mass |
| Releasing agent dispersion (1): | 70 parts by mass |
| Cationic surfactant: (Sanizol B50, manufactured by Kao Corporation: | 1.5 parts by mass |

Above components were accommodated in a round stainless flask, and 12 parts by mass of an aqueous nitric acid solution having a polyaluminum chloride concentration of 10% by mass is added as an aggregating agent. Thereafter, this was dispersed at 30° C. using a homogenizer (Ultra Turrax T50, manufactured by IKA Co.), and the dispersion was heated to 45° C. in a heating oil bath. A volume average particle diameter of the resulting aggregated particles was measured using a Coulter counter (TA2 type, manufactured by Coulter Co.), and was found to be 5.3 μm.

The dispersion in which the aggregated particles are formed was retained at 45° C. for 60 minutes, to this dispersion was slowly added 530 parts by mass of a binder resin fine particle dispersion (4), and this was retained for 120 minutes.

A volume average particle diameter of the resulting adhered resin aggregated particles was measured using a Coulter counter (TA2 type, manufactured by Coulter Co.) and was found to be 6.2 μm. Further, this was heated to 95° C. while stirring was continued, and retained for 2 hours. Thereafter, this was cooled to 20° C at a rate of 10° C./min, filtered, washed with ion exchanged water, and dried using a vacuum drier to obtain toner mother particles having a core shell structure.

A volume average particle diameter (D50%) of the resulting toner mother particles was measured using a Coulter counter (TA2 type, manufactured by Coulter Co.) and was found to be 6.3 μm.

-Preparation of Toner Mother Particles (8)-

| | |
|---|---|
| Binder resin fine particles dispersion (2): | 350 parts by mass |
| Coloring agent dispersion (2): | 100 parts by mass |
| Releasing agent dispersion (1): | 70 parts by mass |
| Cationic surfactant (Sanizol B50, manufactured by Kao Corporation); | 1.5 part by mass |

According to the same manner as that of the toner mother particles (7) except that the aforementioned respective dispersions were used for forming core aggregated particles, and an amount of a binder resin fine particle dispersion (4) to be used is 480 parts by mass, toner mother particles of a volume average particle diameter of 5.8 Am having a core shell structure was obtained.

-Preparation of Toner Mother Particles (9)-

| | |
|---|---|
| Binder resin fine particle dispersion (2): | 200 parts by mass |
| Coloring agent dispersion (1): | 50 parts by mass |
| Releasing agent dispersion (1): | 70 parts by mass |
| Cationic surfactant (Sanizol B50, manufactured by Kao Corporation): | 1.5 parts by mass |

The above components were accommodated in a round stainless flask, and 18 parts by mass of an aqueous nitric acid solution having a polyaluminum chloride concentration of 10 parts by mass was added as an aggregating agent.

Thereafter, this was dispersed at 30° C. using a homogenizer (Ultra Turrax T 50, manufactured by IKA Co.), to the aggregated particle dispersion was slowly added 680 parts by mass of a binder resin fine particle dispersion (5), and this was retained for 120 minutes. This was heated to 95° C. at a rate of 0.5° C./min while stirring was continued, and retained at 95° C. for 3 hours.

Thereafter, this was cooled to 20° C. at a rate of 10° C./min, filtered, washed with ion exchanged water, and dried using a vacuum drier to obtain toner mother particles having a core shell structure. A volume average particle diameter of the resulting toner mother particles was measured using a Coulter counter (TA2 type manufactured by Coulter) and was found to be 6.5 μm.

-Preparation of Toner Mother Particles (10)-

| | |
|---|---|
| Binder resin fine particle dispersion (2): | 150 parts by mass |
| Coloring agent dispersion (2): | 100 parts by mass |
| Releasing agent dispersion (1): | 70 parts by mass |
| Cationic surfactant (Sanizol B50, manufactured by Kao Corporation): | 1.5 parts by mass |

According to the same manner as that of the toner mother particles (9) except that the aforementioned respective dispersion were used for forming core aggregated particles, and an amount of a binder resin fine particle dispersion (5) was 680 parts by mass, toner mother particles of a volume average particle diameter of 6.8 μm having a core shell structure was obtained.

-Preparation of Toner Mother Particles (11)-

| | |
|---|---|
| Binder resin fine particle dispersion (2): | 300 parts by mass |
| Binder resin fine particle dispersion (3): | 380 parts by mass |
| Coloring agent dispersion (1): | 30 parts by mass |
| Releasing agent dispersion (1): | 70 parts by mass |
| Cationic surfactant (Sanizol B50, manufactured by Kao Corporation): | 1.5 parts by mass |

The above components were placed into a round stainless flask, and 16 parts by mass of an aqueous nitric acid solution having a polyaluminum chloride concentration of 10% by weight was added as an aggregating agent. Thereafter, this was dispersed at 30° C. using the homogenizer (Ultra Turrax T50, manufactured by IKA Co.), and the dispersion was heated to 45° C. in a heating oil bath. A volume average particle diameter of the resulting core aggregated particles was measured using a Coulter counter (TA2 type, manufactured by Coulter Co.), and was found to be 5.2 μm. Further, this was heated to 85° C. while stirring was continued, retained for 2 hours, heated to 95° C., and retained for 1 hour to fuse core aggregated particles to obtain core fused particles.

Thereafter, this was cooled to 20° C. at a rate of 20° C./min, and filtered to adjust a moisture rate to 35% by mass. To this dispersion containing core fused particles having a moisture rate of 35% by mass was slowly added 200 parts by mass of a binder resin fine particle dispersion (4), 20 parts by mass of an aqueous nitric acid solution having a polyaluminum chloride concentration of 10% by mass while stirring was performed, and this was retained for 240 minutes. The resulting adhered resin aggregated particles was washed with ion exchange water, and dried using a vacuum drier.

Further, the adhered resin aggregating particles were stirred for 20 minutes with a Henschel mixer to fuse them, to obtain toner mother particles having a core shell structure. A volume average particle diameter of the toner mother particles was measured using a Coulter counter (TA2 type, manufactured by Coulter Co.), and was found to be 6.5 μm.

-Preparation of Toner Mother Particles (12)-

| | |
|---|---|
| Binder resin fine particle dispersion (2): | 300 parts by mass |
| Binder resin fine particle dispersion (3): | 330 parts by mass |
| Coloring agent dispersion (2): | 100 parts by mass |
| Releasing agent dispersion (1): | 70 parts by mass |
| Cationic surfactant (Sanizol B50, manufactured by Kao Corporation): | 1.5 parts by mass |

According to the same manner as that of the toner mother particles (11) except that the aforementioned respective dispersion were used for forming core aggregated particles, toner mother particles of a volume average particle diameter of 6.8 μm having a core shell structure was obtained.

-Preparation of Toner Mother Particles (13)-

| | |
|---|---|
| Binder resin fine particle dispersion (2): | 480 parts by mass |
| Binder resin fine particle dispersion (3): | 350 parts by mass |
| Coloring agent dispersion (1): | 50 parts by mass |
| Releasing agent dispersion (1): | 70 parts by mass |
| Cationic surfactant (Sanizol B50, manufactured by Kao Corporation): | 1.5 parts by mass |

The above components were accommodated in a round stainless flask, and 14 parts by mass of an aqueous nitric acid solution having a polyaluminum chloride concentration of 10% by mass was added. Thereafter, this is dispersed at 30° C. using a homogenizer (Ultra Turrax T50, manufactured by IKA Co.), and this was heated to 40° C. in a heating oil bath. A volume average particle diameter of the resulting aggregating particles was measured using a Coulter counter (TA2 type, manufactured by Coulter Co.), and was found to be 5.2 μm. The dispersion in which aggregated particles were formed is retained at 40° C. for 30 minutes, to this dispersion was slowly added 50 parts by mass of a binder resin fine particle dispersion (7), and this was retained for 30 minutes.

A volume average particle diameter of the resulting adhered resin aggregated particles was measured using a Coulter counter (TA2 type, manufactured by Coulter Co.), and was found to be 5.7 μm. Further this was heated to 96° C. while stirring was continued, and retained for 5 hours. Thereafter, this was cooled to 20° C. at a rate of 1° C./min, filtered, washed with ion exchanged water, and dried with a vacuum drier to obtain the toner mother particles having a core shell structure. A volume average particle diameter of the resulting mother particles was measured using a Coulter counter (TA2 type, manufactured by Coulter Co.), and was found to be 6.0 μm.

-Preparation of Toner Mother Particles (14)-

| | |
|---|---|
| Binder resin fine particle dispersion (2): | 480 parts by mass |
| Binder resin fine particle dispersion (3): | 300 parts by mass |
| Coloring agent dispersion (2); | 100 parts by mass |
| Releasing agent dispersion (1): | 70 parts by mass |
| Cationic surfactant (Sanizol B50, manufactured by Kao Corporation): | 1.5 parts by mass |

According to the same manner as that of the toner mother particles (13) except that the aforementioned respective dispersions were used for forming core aggregated particles, the toner mother particles (14) of a volume average particle diameter of 6.1 μm having a core shell structure was obtained.

-Preparation of Toner Mother Particles (15)-

| | |
|---|---|
| Binder resin fine particle solution (3): | 630 parts by mass |
| Coloring agent dispersion (1): | 50 parts by mass |
| Releasing agent dispersion (1): | 70 parts by mass |
| Cationic surfactant (Sanizol B50, manufactured by Kao Corporation): | 1.5 parts by mass |

The above components were placed in a round stainless flask, and 16 parts by mass of an aqueous nitric acid solution having a polyaluminum chloride concentration was added as an aggregating agent. Thereafter, this was dispersed at 20° C. using a homogenizer (Ultra Turrax T50, manufactured by IKA Co.), and the dispersion was heated to 35° C. in a heating oil bath. Thereafter, 250 parts by mass of a binder resin fine particle dispersion (2) was slowly added, and this was retained for 2 hours. Further, this was heated to 75° C. while stirring was continued, and retained for 5 hours to fuse core aggregated particles to obtain toner mother particles having a core shell structure. A volume average particle diameter of this toner mother particles was measured using a Coulter counter (TA2 type, manufactured by Coulter Co.), and found to be 6.5 μm.

-Preparation of Toner Mother Particles (16)-

| | |
|---|---|
| Binder resin fine particle dispersion (3): | 580 parts by mass |
| Coloring agent dispersion (1): | 100 parts by mass |
| Releasing agent dispersion (1): | 70 parts by mass |
| Cationic surfactant (Sanizol B50, manufactured by Kao Corporation): | 1.5 parts by mass |

According to the same manner as that of the toner mother particles (15) except that the aforementioned respective dispersion were used for forming core aggregated particles, toner mother particles (16) of a volume average particle diameter of 6.3 μm having a core shell structure were obtained.

-Preparation of Toner Mother Particles (17)-

| | |
|---|---|
| Binder resin fine particle dispersion (7): | 680 parts by mass |
| Coloring agent dispersion (1): | 50 parts by mass |
| Releasing agent dispersion (1): | 70 parts by mass |
| Cationic surfactant (Sanizol B50, manufactured by Kao Corporation): | 1.5 parts by mass |

The above components were accommodated in a round stainless flask, and 14 parts by mass of an aqueous nitric acid solution having a polyaluminum chloride concentration of 10% by weight was added as an aggregating agent. Thereafter, this was dispersed at 30° C. using a homogenizer (Ultra Turrax T50, manufactured by IKA Co.), and the dispersion was heated to 40° C. in a heating oil bath. A volume average particle diameter of the resulting aggregated particle was measured using a Coulter counter (TA2 type, manufactured by Coulter Co.), and was found to be 5.1 μm. This dispersion in which aggregated particles were formed was retained at 40° C. for 30 minutes, to this dispersion was slowly added 200 parts by mass of a binder resin fine particle dispersion (5), and this was retained for 90 minutes.

A volume average particle diameter of the resulting adhered resin aggregated particles was measured using a Coulter counter (TA2 type, manufactured by Coulter Co.), and was found to be 5.9 μm. Further, this was heated to 90° C. while stirring is continued, and retained for 2 hours. Thereafter, this was cooled to 20° C. at a rate of 1° C./min, filtered, washed with ion exchanged water, and dried using a vacuum drier to obtain toner mother particles having a core shell structure. A volume average particle diameter of the resulting toner mother particles was measured using a Coulter counter (TA2-type manufactured by Coulter), and was found to be 6.2 μm.

-Preparation of Toner Mother Particles (18)-

| | |
|---|---|
| Binder resin fine particle dispersion (7): | 630 parts by mass |
| Coloring agent dispersion (2): | 100 parts by mass |
| Releasing agent dispersion (1): | 70 parts by mass |
| Cationic surfactant (Sanizol B50, manufactured by kao Corporation): | 1.5 parts by mass |

According to the same manner as that of the toner mother particles (17) except that the aforementioned respective dispersions were used for forming core aggregated particles, toner mother particles of a volume average particle diameter of 6.9 μm having a core shell structure was obtained.

-Preparation of Toner Mother Particles (19)-

| | |
|---|---|
| Binder resin fine particle dispersion (1): | 670 parts by mass |
| Coloring agent dispersion (1): | 50 parts by mass |
| Releasing agent dispersion (1): | 70 parts by mass |
| Cationic surfactant (Sanizol B50, manufactured by Kao Corporation): | 1.5 parts by mass |

The above components were accommodated in a round stainless flask, and 14 parts by mass of an aqueous nitric acid solution having a polyaluminum chloride concentration is added as an aggregating agent. Thereafter, this is dispersed at 30° C. using a homogenizer (Ultra Turrax T50, manufactured by IKA Co.), and this was heated to 40° C. in a heated oil bath. A volume average particle diameter of the resulting aggregated particles was measured using a Coulter counter (TA2 type, manufactured by Coulter Co.) and was found to be 4.7 μm. The dispersion in which aggregated particles were formed was retained at 40° C. for 60 minutes, to this dispersion was slowly added 210 parts by mass of a resin fine particle dispersion (7), and this was retained for 30 minutes.

A volume average particle diameter of the resulting adhered resin aggregated particles was measured using a Coulter counter (TA2 type, manufactured by Coulter Co.), and was founded to be 5.7 μm. Further, this was heated to 90° C. while stirring was continued and retained for 5 hours. Thereafter, this was cooled to 20° C. at a rate of 1° C./min, filtered, washed with ion exchanged water, and dried using a vacuum drier to obtain toner mother particles having a core shell structure. A volume average particle diameter of the resulting toner mother particle was measured using a Coulter counter (TA2 type, manufactured by Coulter Co.), and was found to be 5.8 ∞m.

-Preparation of Toner Mother Particles (20)-

| | |
|---|---|
| Binder resin fine particle dispersion (1): | 620 parts by mass |
| Coloring agent dispersion (2): | 100 parts by mass |
| Releasing agent dispersion (1): | 70 parts by mass |
| Cationic surfactant (Sanizol B50, manufactured by Kao Corporation): | 1.5 parts by mass |

According to the same manner as that of the toner mother particles (19) except that the aforementioned respective dispersions were used for forming core aggregated particles, toner mother particles (20) of a volume average particle diameter of 5.7 μm having a core shell structure was obtained.

Properties of binder resins used for preparing respective toner mother particles were shown in Table 1.

Herein, regarding toner mother particles 3, 4, 11, 12, 13 and 14, since a plurality of binder resins for a core layer were used by mixing them, viscoelastcity values measured by separately blending two kinds of resins were described. Regarding toner mother particles 3, 4, 11, 12, 13 and 14, since a SP value of a resin blend for a core layer was unknown, it was not described.

<Various Assessments of Toner>

(Preparation of Carrier)

| | |
|---|---|
| Ferrite particles (volume average particle diameter: 50 μm): | 100 parts by mass |
| Toluene: | 14 parts by mass |
| Styrene-methyl methacrylate copolymer (component ratio: styrene/methyl methacrylate = 90/10, weight average molecular weight Mw = 80,000): | 2 parts by mass |
| Carbon black (R330: manufactured by Cabott): | 0.2 part by mass |

First, the above components except for ferrite particles were stirred with a stirrer for 10 minutes to obtain a dispersed covering solution, then, this covering solution and ferrite particles were placed into a vacuum evacuating-type kneader, stirred at 60° C. for 30 minutes, further a pressure was reduced to evacuate the air while the system was warmed, and dried to obtain a carrier.

(Preparation of Developer)

Commercially available fumed silica RX50 (manufactured by Aerosil Co.) as an external additive was added to each of toner mother particles (1) to (20) at an amount of 1.2 parts by mass relative to 100 parts by mass of the toner, and mixed with a Henschel mixer to obtain each of toners for electrostatic charge image developing (1) to (20).

Then, 5 parts by mass of each of these toners and 100 parts by mass of the carrier were mixed to prepare any of two component developers (1) to (20).

(Measurement of Viscoelasticity)

A storage elastic modulus was obtained from dynamic viscoelasticity measured by a sine wave vibration method. An ARES measuring apparatus manufactured by Rheometric Scientific was used for measuring dynamic viscoelasticity Measurement of dynamic viscoelasticity was performed by setting a toner molded into a tablet on a parallel plate having a diameter of 8 mm, adjusting a normal force to 0, and imparting sine wave vibration at a vibration frequency of 6.28 rad/sac. Measurement was initiated at 20° C., and was continued

TABLE 1

| | Storage elastic modulus at 80° C. of binder resin for core layer | Storage elastic modulus at 80° C. of binder resin for shell layer | Ratio of storage elastic modulus at 80° C. of binder resin for core layer and binder resin for shell layer | SP value difference between binder resin for core layer and binder resin for shell layer |
|---|---|---|---|---|
| Toner mother particles 1, 2 | $3.58 \times 10^4$ | $4.49 \times 10^5$ | 12.5 | 0.57 |
| Toner mother particles 3, 4 | $2.23 \times 10^4$ | $4.49 \times 10^5$ | 20.1 | — |
| Toner mother particles 5, 6 | $3.58 \times 10^4$ | $5.68 \times 10^7$ | $1.59 \times 10^3$ | 0.14 |
| Toner mother particles 7, 8 | $2.41 \times 10^2$ | $4.49 \times 10^5$ | $1.83 \times 10^3$ | 1.16 |
| Toner mother particles 9, 10 | $2.41 \times 10^2$ | $5.68 \times 10^7$ | $2.36 \times 10^5$ | 0.73 |
| Toner mother particles 11, 12 | $9.78 \times 10^3$ | $4.49 \times 10^5$ | 45.9 | — |
| Toner mother particles 13, 14 | $3.30 \times 10^3$ | $1.03 \times 10^6$ | $1.13 \times 10^2$ | — |
| Toner mother particles 15, 16 | $1.05 \times 10^4$ | $3.58 \times 10^4$ | 3.40 | 0.04 |
| Toner mother particles 17, 18 | $1.03 \times 10^6$ | $5.68 \times 10^7$ | 55.0 | 0.14 |
| Toner mother particles 19, 20 | $3.58 \times 10^4$ | $1.03 \times 10^6$ | 28.0 | 0.28 |

to 100° C. A measurement time interval was 30 seconds, and a rise in temperature was at 1° C./min.

Before measurement, stress dependency of an amount of strain was confirmed at an interval of 10° C. from 20° C. to 100° C., and a range of an amount of a strain that a stress and a strain amount at each temperature have a linear relationship was obtained. And, a strain amount at each measurement temperature was maintained in a range of 0.01% to 0.5% during measurement, and the condition is controlled so that a stress and a strain amount at all temperatures have a linear relationship, and a storage elastic modulus and a tangential loss were obtained.

(Volume Average Particle Diameter)

Upon measurement of a volume average particle diameter of a toner, a Coulter counter TA-2 (manufactured by Beckmann Coulter Co.) was used, and ISOTON-II (manufactured by Beckman Coulter Co.) was used as an electrolyte solution.

First, 0.5 to 50 mg of a measurement sample was added to 2 ml of a 5 weight % aqueous solution of a surfactant, preferably, sodium alkylbenzenesulfonate as a dispersant, and this was added to 100 to 150 ml of the aforementioned electrolyte solution, to prepare a sample.

Subsequently, an electrolyte solution in which a measurement sample was suspended was dispersing-treated with an ultrasound dispersing equipment for about 1 minute, and a particle diameter distribution of particles of 2.0 to 50.8 μm was measured with the Coulter counter TA-II type using an aperture of an aperture diameter of 100 μm, to obtain a volume average distribution, and a number average distribution.

A measured particle size distribution was drawn into an accumulation distribution relative to a divided particle size range (channel) from a small diameter side using a volume standard, and a particle diameter at accumulation of 50% (D50v) was adopted as a volume average particle diameter Example 1

Fixation assessment was performed using a developer (1) and a developer (2).

Example 2

Fixation assessment was performed using a developer (3) and a developer (4).

Example 3

Fixation assessment was performed using a developer (11) and a developer (12).

Example 4

Fixation assessment was performed using a developer (19) and a developer (20).

Comparative Example 1

Fixation assessment was performed using a developer (5) and a developer (6).

Comparative Example 2

Fixation assessment was performed using a developer (7) and a developer (8).

Comparative Example 3

Fixation assessment was performed using a developer (9) and a developer (10).

Comparative Example 4

Fixation assessment was performed using a developer (13) and a developer (14).

Comparative Example 5

Fixation assessment was performed using a developer (15) and a developer (16).

Comparative Example 6

Fixation assessment was performed using a developer (17) and a developer (18).

-Assessment Results-

Assessment results of viscoelasticity of a toner for electrostatic charge image developing and assessment results of low temperature fixability/color developing reproducibility are shown in Table 2.

TABLE 2

| | | | Storage elastic modulus at 60° C. G'(60) (Pa) | Ratio of storage elastic modulus at 60° C. and storage elastic modulus at 80° C. (G'(60)/G'(80)) | Peak number of tangential loss in range of not lower than 30° C. and not higher than 90° C. | Lowest fixing temperature (° C.) | Low temperature fixability assessment | ΔC | Color development reproducibility assessment |
|---|---|---|---|---|---|---|---|---|---|
| Example 1 | Toner 1 | Toner mother particles 1 | $2.5 \times 10^6$ | 18.0 | 2 | 100 | G2 | 1.8 | G1 |
| | Toner 2 | Toner mother particles 2 | $3.3 \times 10^6$ | 14.3 | 2 | | | | |
| Example 2 | Toner 3 | Toner mother particles 3 | $8.7 \times 10^5$ | 28.2 | 2 | 95 | G1 | 2.5 | G2 |
| | Toner 4 | Toner mother particles 4 | $9.5 \times 10^5$ | 23.8 | 2 | | | | |
| Comparative Example 1 | Toner 5 | Toner mother particles 5 | $5.3 \times 10^7$ | 135.0 | 1 | 140 | G4 | Immeasurable | G4 |
| | Toner 6 | Toner mother particles 6 | $6.2 \times 10^7$ | 122.5 | 1 | | | | |

TABLE 2-continued

| | | | Storage elastic modulus at 60° C. G'(60) (Pa) | Ratio of storage elastic modulus at 60° C. and storage elastic modulus at 80° C. (G'(60)/G'(80)) | Peak number of tangential loss in range of not lower than 30° C. and not higher than 90° C. | Lowest fixing temperature (° C.) | Low temperature fixability assessment | ΔC | Color development reproduc-ibility assessment |
|---|---|---|---|---|---|---|---|---|---|
| Comparative Example 2 | Toner 7 | Toner mother particles 7 | $2.1 \times 10^5$ | 55.9 | 1 | 90 | G1 | 5.6 | G4 |
| | Toner 8 | Toner mother particles 8 | $2.7 \times 10^5$ | 53.2 | 1 | | | | |
| Comparative Example 3 | Toner 9 | Toner mother particles 9 | $1.0 \times 10^7$ | 22.9 | 1 | 115 | G3 | 7.5 | G4 |
| | Toner 10 | Toner mother particles 10 | $1.8 \times 10^7$ | 19.8 | 1 | | | | |
| Example 3 | Toner 11 | Toner mother particles 11 | $3.2 \times 10^5$ | 33.7 | 2 | 93 | G1 | 2.8 | G2 |
| | Toner 12 | Toner mother particles 12 | $3.5 \times 10^5$ | 35.1 | 2 | | | | |
| Comparative Example 4 | Toner 13 | Toner mother particles 13 | $5.5 \times 10^4$ | 64.5 | 1 | 88 | G1 | 10.5 | G4 |
| | Toner 14 | Toner mother particles 14 | $6.1 \times 10^4$ | 65.2 | 1 | | | | |
| Comparative Example 5 | Toner 15 | Toner mother particles 15 | $8.8 \times 10^4$ | 9.51 | 1 | 88 | G1 | 5.2 | G4 |
| | Toner 16 | Toner mother particles 16 | $7.2 \times 10^4$ | 9.81 | 1 | | | | |
| Comparative Example 6 | Toner 17 | Toner mother particles 17 | $3.5 \times 10^8$ | 25.8 | 1 | 155 | G4 | Immeasur-able | G4 |
| | Toner 18 | Toner mother particles 18 | $4.3 \times 10^8$ | 26.9 | 1 | | | | |
| Example 4 | Toner 19 | Toner mother particles 19 | $2.9 \times 10^6$ | 22.5 | 2 | 105 | G2 | 1.9 | G1 |
| | Toner 20 | Toner mother particles 20 | $3.4 \times 10^6$ | 23.8 | 2 | | | | |

As seen from results of Table 2, in Examples 1 to 4, low temperature fixation at 100° C. or lower was possible, and reproducibility of color development at continuous output was stable. However, in Comparative Example 1, since a storage elastic modulus at 60° C. was higher than $4.0\times10^6$ Pa, and a ratio G'(60)/G'(80) of a storage elastic modulus G'(60) at 60° C. and a storage elastic modulus G'(80) at 80° C. was greater than 40.0, low temperature fixation was difficult.

In Comparative Example 2, a storage elastic modulus at 60° C. was not lower than $2.0\times10^5$ Pa and not higher than $4.0\times10^6$ Pa, but since a ratio G'(60)/G'(80) was greater than 40, lower temperature fixation was possible, but reproducibility of color development at continuous output was not stable.

In Comparative Example 3, a ratio G'(60)/G'(80) was 40 or lower, but a storage elastic modulus at 60° C. was higher than $4.0\times10^6$Pa, reproducibility of color development at continuous output at low temperature fixation was not stable.

In Comparative Examples 1 to 6, it was considered that since a combination of viscoelasticities of a binder resin for a core layer and a binder resin for a shell layer, and control of a SP value were not proper, the number of peak of a tangential loss was one, and both of low temperature fixation and reproducibility of color development at continuous output could not be compatible.

Apparatuses used for assessing low temperature fixability and color development reproducibility shown in Table 2, and methods for assessing low temperature fixability and color development reproducibility, and assessment criteria were as follows.

(Image Forming Apparatus)

For assessment, a modified machine of DocuPrint C2221 manufactured by Fuji Xerox Co., Ltd. was used. A 900W halogen lamp was built in a heating roll as a heating means for a nip part in a fixing machine of this apparatus, and a set fixation temperature of a fixing machine could be changed in a range of 70° C. to 200° C.

In addition, this apparatus was provided with a waiting term power saving function and, when a set fixation temperature of a fixing machine was set at 115° C. at image formation (at fixation), a set waiting temperature at waiting was maintained at 110° C.

Further, a warming up time when a set fixation temperature of a fixing machine was set at 115° C. is about 15 seconds. A warming up time is a time necessary until formation of an image becomes possible when an image is formed from the waiting state, and substantially corresponds to a time until a temperature reaches a set fixation temperature from a set waiting temperature.

(Low Temperature Fixability Assessment)

Using a modified machine of DocuPrint C2221 manufactured by Fuji Xerox Co., Ltd., fixation assessment was performed. Assessment was performed by a binary color (Green) in which a Cyan color toner and a Yellow color toner were overlaid.

Upon assessment, first, a machine was adjusted so that a single color toner amount on a paper (J paper, manufactured by Fuji Xerox Co., Ltd.) became 4.8 g/m$^2$, a Yellow color toner layer was formed on a Cyan color toner layer, to prepare a 25 mm×25 mm Green color unfixed plain image.

Then, using a sheet on which this unfixed plain image was formed, an unfixed image was fixed while a fixation temperature of a fixing machine was step-wisely raised between 70° C. and 200° C., to obtain a fixed image.

Offset of an image prepared at a fixation temperature of 70° C. to 200° C. was assessed with naked eyes. A temperature at which occurrence of offset is stopped at a low temperature was assessed as a lowest fixation temperature. Assessment criteria of low temperature fixability were as follows.

G1: A lowest fixation temperature was 100° C. or lower.

G2: A lowest fixation temperature was higher than 100° C. and lower than 110° C.

G3: A lowest fixation temperature was not lower than 110° C. and lower than 120° C.

G4: A lowest fixation temperature was not lower than 120° C.

(Assessment of Color Development Reproducibility)

Using a modified machine of DocuCenter Color 500 manufactured by Fuji Xerox Co., Ltd., fixation assessment was performed. Assessment is performed by a binary color (Green) in which a Cyan color toner and a Yellow color toner were overlaid.

A machine was adjusted so that a single color toner amount on a paper (J paper, manufactured by Fuji Xerox Co. Ltd.) becomes 4.5 g/m$^2$, a Yellow color toner layer was formed on a Cyan color toner layer, to prepare a 25 mm×25 mm Green color unfixed plain image.

Then, the waiting state was sufficiently maintained until a temperature of a fixing machine became in the steady state, and 30 sheets continuous fixation was performed from the waiting state to a set fixation temperature of 115° C. Color developing property of a fixed image was assessed using X-Rite 528 (manufactured by X-Rite Co.).

C* of the resulting image was measured in each sheet, and a difference ΔC ($=C^*_{MAX}-C^*_{MIN}$) between a maximum of C* ($C^*_{MAX}$) and a minimum of C* ($C^*_{MIN}$) among 30 sheets was obtained. Herein, smaller ΔC means that scatter of color developing property in each sheet at continuous output is smaller. In C* measurement, five points in a 25 mm×25 mm image plane were measured, and an average was obtained.

Specific assessment criteria were as follows:

G1: ΔC was 2 or less.

G2: ΔC was more than 2 and 3 or less.

G3: ΔC was not less than 3 and less than 5.

G4: ΔC was not less than 5.

C* is a value shown by the following equation (4).

$$C^*=(a^{*2}+b^{*2})^{1/2} \quad \text{Equation (4)}$$

Wherein, a* and b* mean a* and b* in L*a*b* color specification system defined in JIS Z8729.

What is claimed is:

1. A toner for electrostatic charge image developing, comprising a core layer which contains a first binder resin and a coloring agent, and a shell layer which contains a second binder resin and covers the core layer, characterized in that the following equation (1) and the following equation (2) are satisfied, $$2.0\times10^5 \leqq G'(60) \leqq 4.0\times10^6 \quad \text{Equation (1)}$$

$$10 \leqq G'(60)/G'(80) \leqq 40 \quad \text{Equation (2)}$$

wherein, in the equation (1) and the equation (2), G'(60) represents a storage elastic modulus (Pa) of the toner for electrostatic charge image developing measured under the conditions of a temperature of 60° C., a vibration frequency of 6.28 rad/sec, and a strain amount of 0.01 to 0.5%, and G'(80) represents a storage elastic modulus (Pa) of the toner for electrostatic charge image developing measured under the conditions of a temperature of 80° C., a vibration frequency of 6.28 rad/sec, and a strain amount of 0.01 to 0.5%.

2. The toner for electrostatic charge image developing of claim 1, wherein two maximum values of tangential loss measured under the conditions of a vibration frequency of 6.28 rad/sec and a strain amount of 0.01 to 0.5% are present in a range of not lower than 30° C. and not higher than 90° C.

3. The toner for electrostatic charge image developing of claim 1, wherein a difference ΔSP (|SPc−SPs|) between a solubility parameter SPc of the first binder resin and a solubility parameter SPs of the second binder resin is in a range of 0.2 to 0.6.

4. The toner for electrostatic charge image developing of claim 1, further comprising an inorganic compound in a range of 0.3 to 3 parts by mass relative to 100 parts by mass of toner particles.

5. The toner for electrostatic charge image developing of claim 1, further comprising a releasing agent.

6. A developer for electrostatic charge image developing, comprising a toner for electrostatic charge image developing having a core layer which contains a first binder resin and a coloring agent, and a shell layer which contains a second binder resin and covers the core layer, and satisfies the following equation (1) and the following equation (2), and a carrier, $$2.0\times10^5 \leqq G'(60) \leqq 4.0\times10^6 \quad \text{Equation (1)}$$

$$10 \leqq G'(60)/G'(80) \leqq 40 \quad \text{Equation (2)}$$

wherein, in the equation (1) and the equation (2), G'(60) represents a storage elastic modulus (Pa) of the toner for electrostatic charge image developing measured under the conditions of a temperature of 60° C., a vibration frequency of 6.28 rad/sec, and a strain amount of 0.01 to 0.5%, and G'(80) represents a storage elastic modulus (Pa) of the toner for electrostatic charge image developing measured under the conditions of a temperature of 80° C., a vibration frequency of 6.28 rad/sec, and a strain amount of 0.01 to 0.5%.

7. The developer for electrostatic charge image developing of claim 6, wherein a volume specific resistance of the carrier is in a range of $10^6$ to $10^{13}$ Ω·cm at 1,000V.

8. An image forming apparatus, comprising an image carrying body, an charging means for charging a surface of the image carrying body, an exposing means for forming an electrostatic latent image on a surface of the charged image carrying body based on image information, a developing means for developing the electrostatic latent image with a developer containing a toner to form a toner image on a surface of the image carrying body, a transferring means for transferring the toner image onto a surface of a recording medium from the surface of the image carrying body, and a fixing means for fixing the toner image transferred onto the surface of the recording medium by heating and pressing, to form an image, wherein the toner is a toner for electrostatic charge image developing having a core layer which contains a first binder resin and a coloring agent, and a shell layer which contains a second binder resin and covers the core layer, and satisfies the following equation (1) and the following equation (2), $$2.0\times10^5 \leqq G'(60) \leqq 4.0\times10^6 \quad \text{Equation (1)}$$

$$10 \leqq G'(60)/G'(80) \leqq 40 \quad \text{Equation (2)}$$

and wherein, in the equation (1) and the equation (2), G'(60) represents a storage elastic modulus (Pa) of the toner for electrostatic charge image developing measured under the conditions of a temperature of 60° C., a vibration frequency of 6.28 rad/sec, and a strain amount of 0.01 to 0.5%, and G'(80) represents a storage elastic modulus (Pa) of the toner for electrostatic charge image developing measured under the conditions of a temperature of 80° C., a vibration frequency of 6.28 rad/sec, and a strain amount of 0.01 to 0.5%.

9. The image forming apparatus of claim 8, wherein the fixing means includes a heating means having at least function of heating the toner image, and has a function of maintaining the temperature of the heating means at a temperature lower than the temperature during fixing when there is a prolonged period where an image is not formed.

10. The image forming apparatus of claim 8, wherein an actual average fixing temperature of the fixing means is 120° C. or lower.

* * * * *